United States Patent [19]

Pease

[11] 3,977,447

[45] Aug. 31, 1976

[54] HARVESTER CHIPPER MACHINE

[76] Inventor: Lionel Pease, 2333 NW. 98th, Seattle, Wash. 98107

[22] Filed: May 18, 1973

[21] Appl. No.: 361,825

Related U.S. Application Data

[63] Continuation-in-part of Ser. No. 848,994, Aug. 11, 1967, Pat. No. 3,884,281.

[52] U.S. Cl. ..... 144/172; 144/218; 144/39; 144/41; 144/326 R

[51] Int. Cl.[2] ..... B27L 11/02

[58] Field of Search ..... 144/162, 172, 218, 39, 144/41, 326 X; 83/425.4, 508.2

[56] References Cited

UNITED STATES PATENTS

| | | | |
|---|---|---|---|
| 1,936,242 | 11/1933 | Orr | 83/842 |
| 2,816,581 | 12/1957 | Traben | 83/425.4 |
| 3,082,802 | 3/1963 | Dickson et al. | 144/326 |
| 3,259,157 | 7/1966 | Runnion | 144/176 |
| 3,447,578 | 6/1969 | Mitten | 144/218 |
| 3,630,244 | 12/1971 | Cromeens | 83/508.2 |

*Primary Examiner*—Donald R. Schran

[57] ABSTRACT

This invention is directed to apparatus and method for working pieces of wood and which pieces of wood may have a flat side or may be a log.

The apparatus and method are directed to the climb cutting or climb milling, on the face of the wood, and the rotary milling, cutting through the wood, to the working of said pieces of wood so as to form useable lumber and to form useable wood chips, and which wood chips can be further processed to make useful products of manufacture.

One of the side features of this invention is the utilization of small pieces of wood and which small pieces of wood, prior to this invention, were either chipped or burned instead of being further processed to more economically valuable lumber.

19 Claims, 75 Drawing Figures

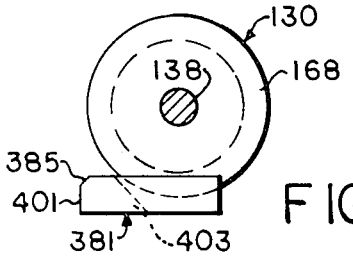
FIG. 8
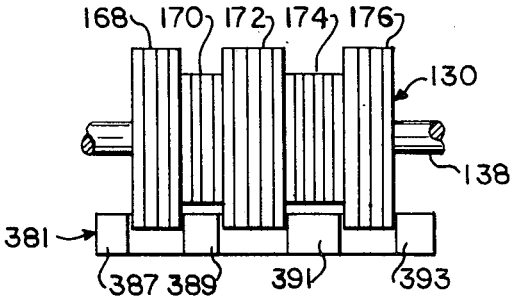
FIG. 9
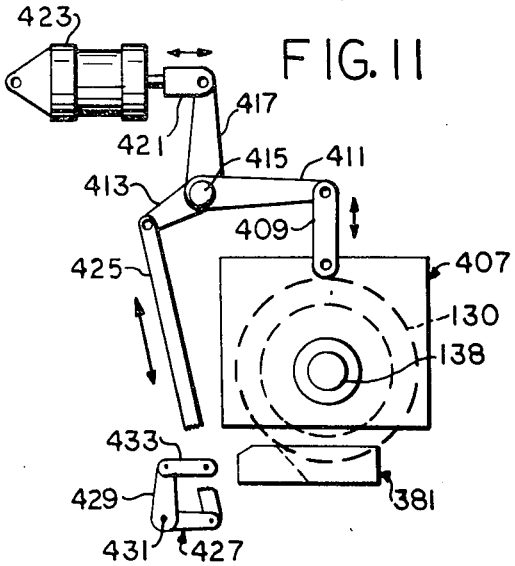
FIG. 11
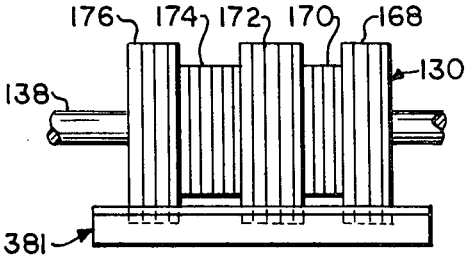
FIG. 10
FIG. 12
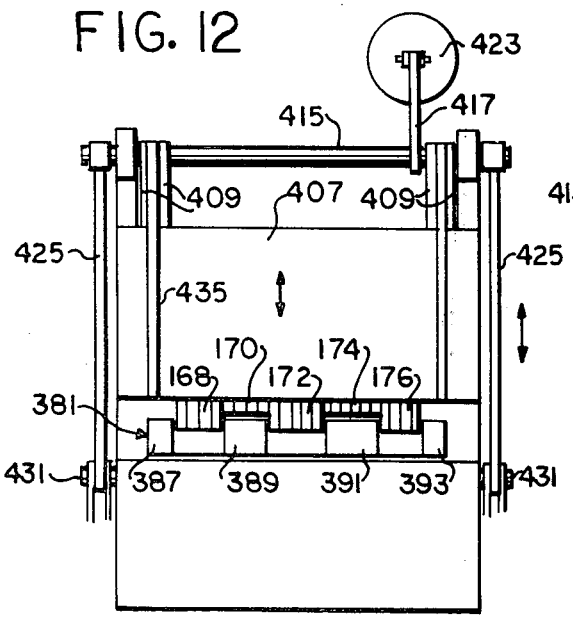
FIG. 13
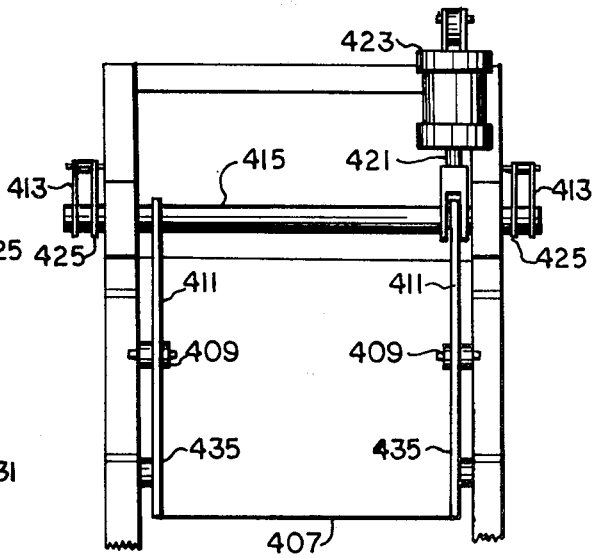

FIG. 14
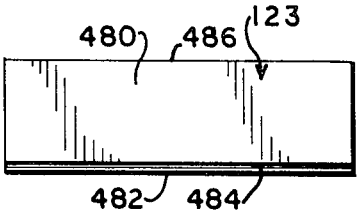
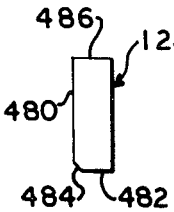
FIG. 15
FIG. 16
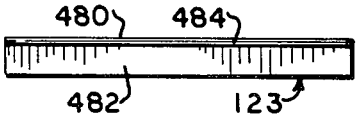
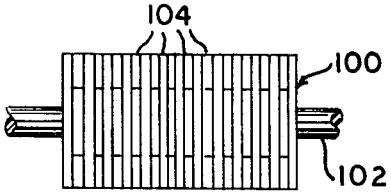
FIG. 17
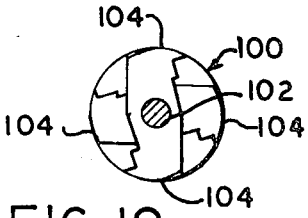
FIG. 18
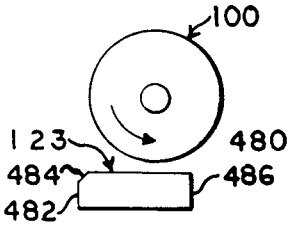
FIG. 19
FIG. 20
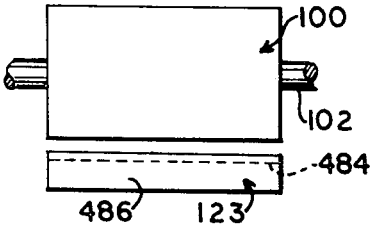
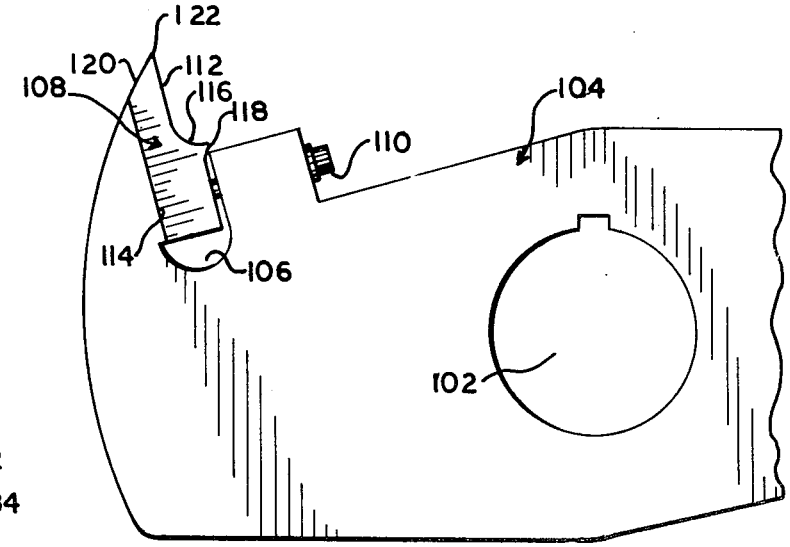
FIG. 21

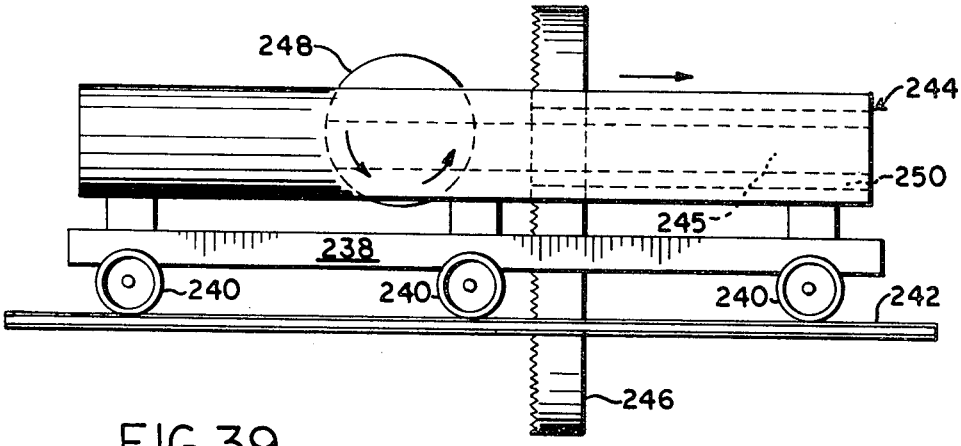
FIG. 39
FIG. 40
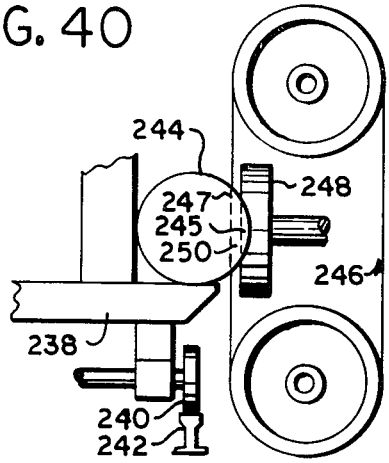
FIG. 41
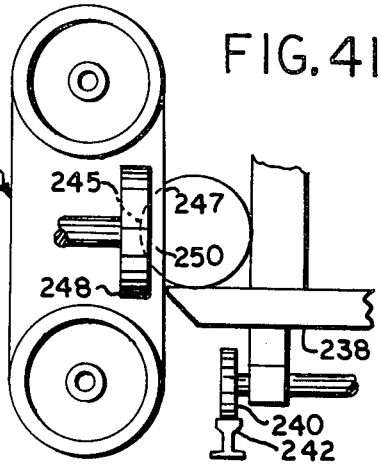
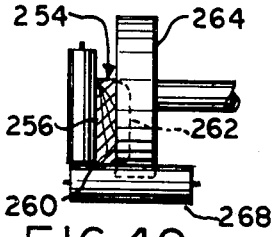
FIG. 42
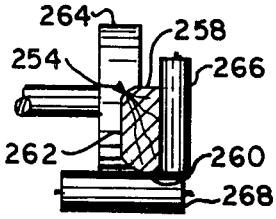
FIG. 43
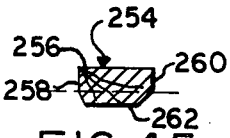
FIG. 45
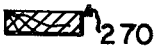
FIG. 46
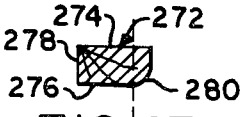
FIG. 47
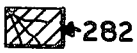
FIG. 48
FIG. 44
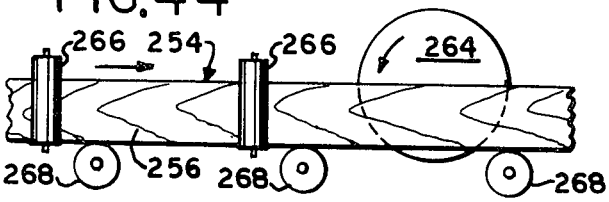
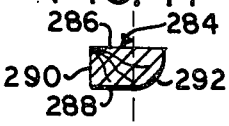
FIG. 49
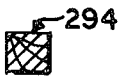
FIG. 50

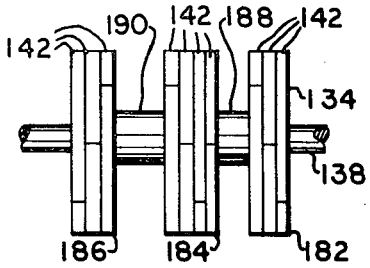
FIG. 51
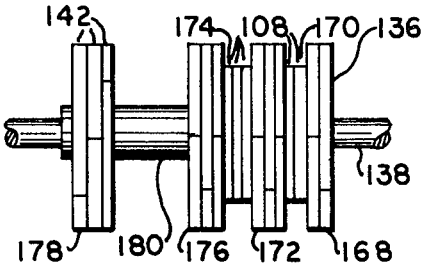
FIG. 52
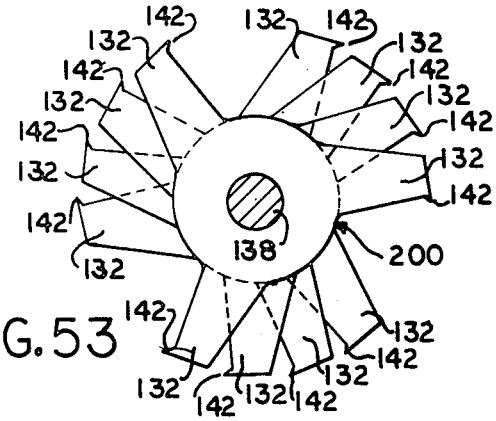
FIG. 53
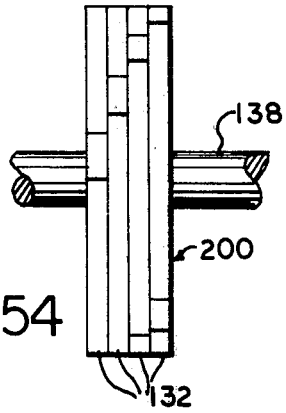
FIG. 54
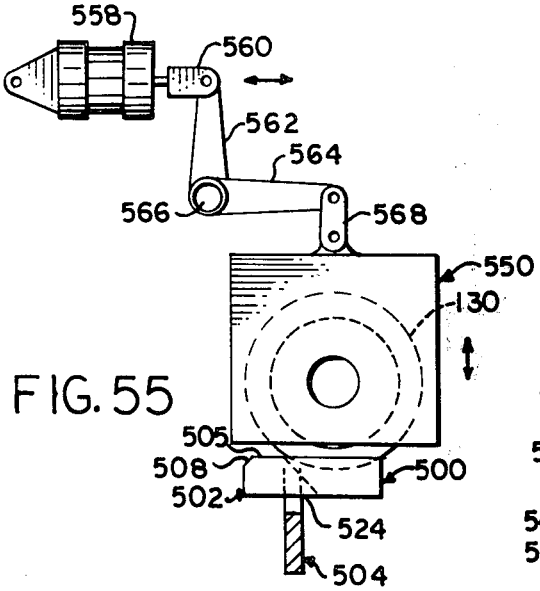
FIG. 55
FIG. 56
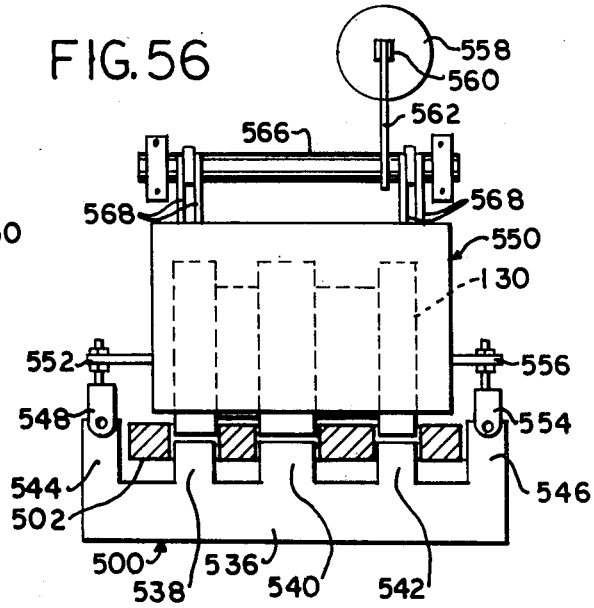
FIG. 57
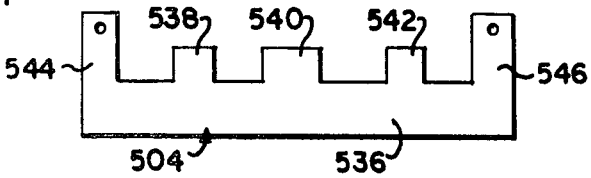

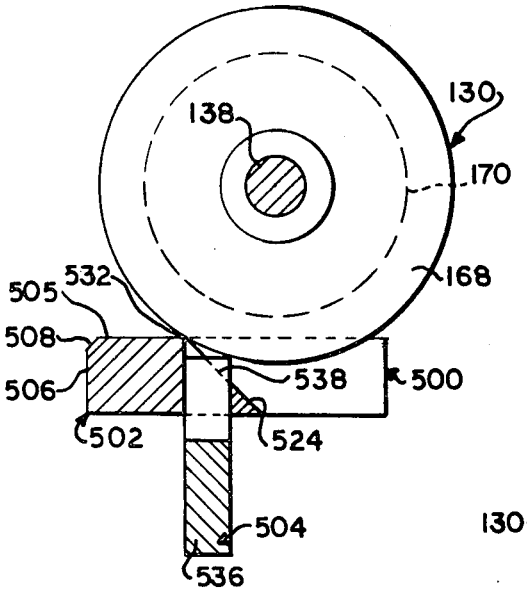
FIG. 65
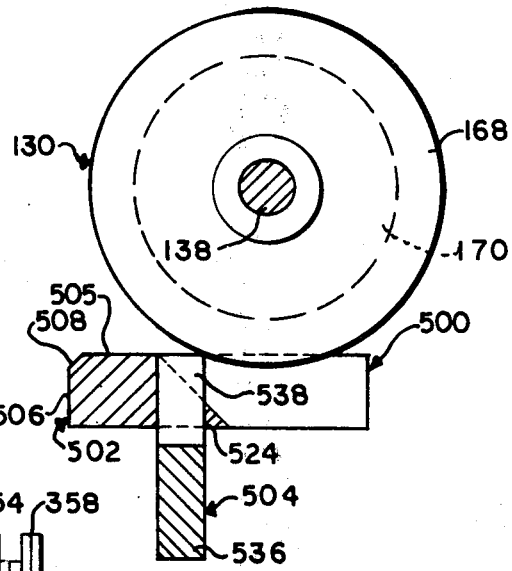
FIG. 66
FIG. 67
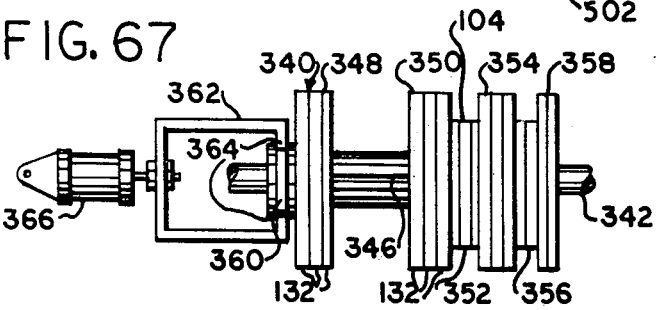
FIG. 68
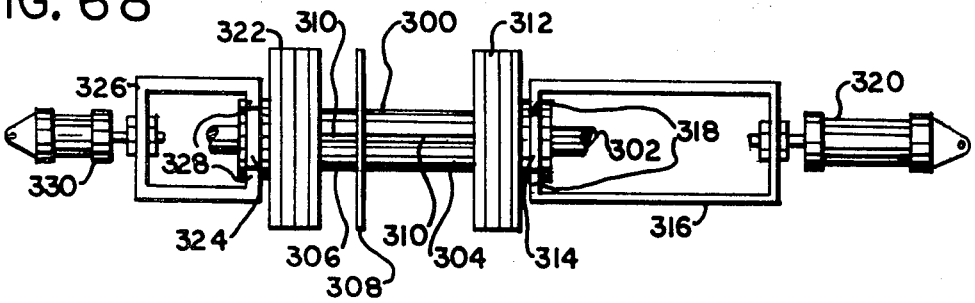

FIG. 69
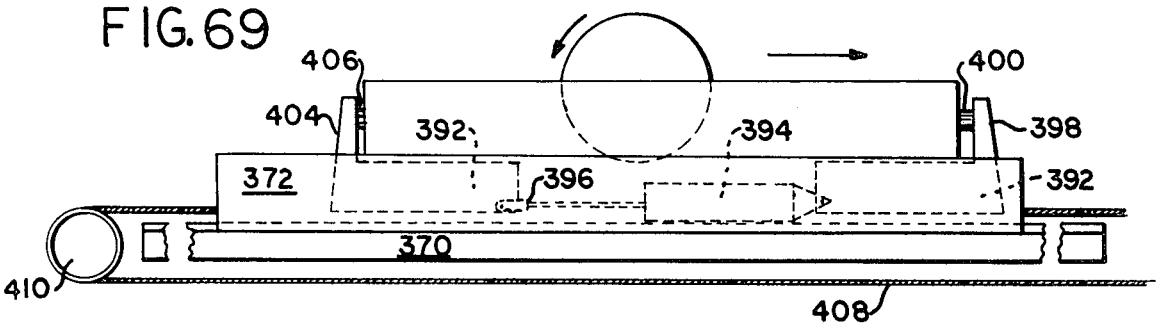
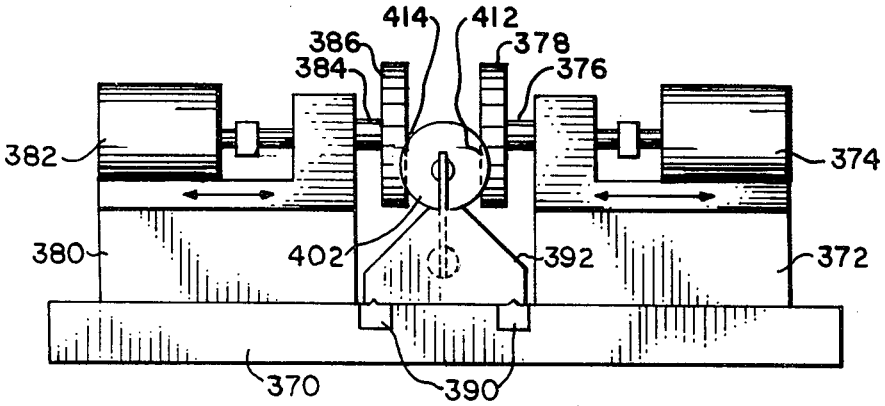
FIG. 70
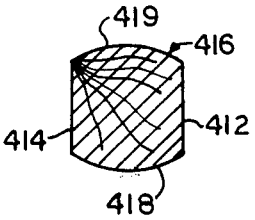
FIG. 71
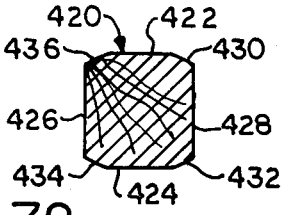
FIG. 72
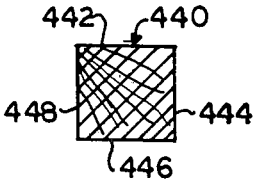
FIG. 73
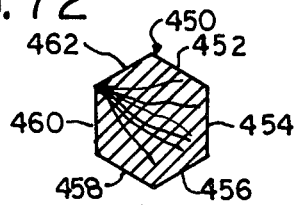
FIG. 74
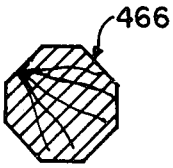
FIG. 75

HARVESTER CHIPPER MACHINE

This application is a continuation-in-part application of my copending application Ser. No. 848,994, filing date of Aug. 11, 1969, entitled HARVESTER CHIPPER MACHINE now U.S. Pat. No. 3,884,281.

This invention is directed to apparatus and methods for increasing the economic value of products from pieces of wood. Prior to this invention, small pieces of wood were usually burned in a burner so as to pollute the surrounding atmosphere or were chipped to make chips. The economic value of the chips was greater than the economic value of pieces of wood being burned in a burner. However, if the pieces of wood consigned to the burner could have been further processed to make lumber, the economic value of the lumber would be greater than the economic value of the chips. Therefore, this invention is directed to raising the economic value of the products from pieces of wood so as to realize a greater monetary return from these pieces of wood that has been previously realized.

There is a scarcity of apparatus and methods for the working of small pieces of wood such as slabs, flitches, mismanufactured pieces of lumber and logs in the range of 3 to 48 inches in diameter so as to make useful lumber products. It is possible to burn or chip the slabs, flitches and the small logs less than about 6 inches in diameter. However, with the burning and the chipping of these pieces of wood, the maximum economic value is not being realized. A piece of lumber is more valuable than wood chips while wood chips are more valuable than wood discards sent to the burner. If these small pieces of wood are chipped, there is thrown away potentially valuable lumber. The lumber may be a 1 by 1 inch piece, or a 1 by 2 inch piece, or a 1 by 3 inch piece of lumber. These small pieces of lumber can be used in the manufacture of trailers, dividers, skids for small appliances, and pallet boards. And, in certain instances, these small pieces of lumber are used in furniture framing. As is readily apparent, if the small pieces of wood are converted into chips, the maximum realizable value from the small pieces of wood is not obtained. Instead, a lower economic return is realized from these small pieces of wood when converted into chips as compared to being converted into the combination of small pieces of lumber and useful wood chips. It is to be realized that in addition to making these small pieces of lumber, the subject of this invention can economically make larger pieces of lumber such as 2 by 4 inches, 2 by 6 inches and larger pieces of lumber than these.

In the breakdown of a log, one of the ways to break down the log is to remove slabs and flitches from the log. In many instances, there is sufficient potential lumber in a slab to make it worthwhile to further process the slab to make lumber and useful wood chips. For example, a slab may contain at least one 1 by 2 inches of at least 6 feet in length. With the methods and apparatus of this invention, it is economically useful to process this slab to make this one 1 by 2 inches and the useful wood chips. In many small logs, the slab is sawed especially thick so as to eliminate one saw line. With the methods and apparatus of this invention, it is possible to eliminate saw lines and therefore eliminate useless sawdust or, in other words, to make useful chips out of the wood and which wood, prior to this invention, would have been partially turned into useless sawdust.

Another way of breaking down a log is to chip away the periphery of the log so as to form wood chips and to form a cant. A limitation on the chipping of a log is that presently available equipment will handle a log of a maximum diameter of 24 inches, see my U.S. Pat. No. 3,373,782, entitled SIDE, TOP AND BOTTOM CHIPPERS, Issuing date of Mar. 19, 1968.

With mismanufactured lumber such as lumber having two flat sides and two curved sides or lumber having two flat sides and one curved side or lumber having three flat sides and one curved side, it is possible, with the apparatus and methods of this invention, to further economically process this mismanufactured lumber to useful lumber and to useful wood chips instead of converting all of this mismanufactured lumber to chips or hog fuel or to send it to the burner.

With the apparatus and teachings of this invention, it is possible to process logs up to 48 inches in diameter. Instead of sawing of slabs and flitches or chipping off the exterior of the log, it is possible to substantially simultaneously saw and chip the log to form a wane edge flitch and useful wood chips. Then, the wane edge flitch can be further processed and chipped to form a cant and useful wood chips.

Accordingly, an object of this invention is to provide a chipper head which can simultaneously top chip and side chip, on two sides, a piece of wood; another object is to provide a chipper head which can simultaneously side chip two sides of a piece of wood and chip said piece of wood to split or divide said piece of wood into two pieces of wood; an additional object is to provide the combination of feed means and a chipper head to keep a piece of wood in a straight travel line; a further object is to provide an apparatus for the simultaneous moving of an anvil and a chipper head; an additional object is to provide a unique knife structure for regularly and annularly chipping a piece of wood; another important object is to provide an apparatus for climb cutting or climb milling so as to chip the face of a piece of wood and to provide apparatus for rotary milling for chipping into the body of a piece of wood; another important object is to provide a salvage machine which makes it possible to save one sawdust line in the working of a piece of wood in that there is a combination of a chipper head and a saw in association with the head rig for working a log; another object is to provide a harvester machine and which harvester machine may save up to three sawdust lines and also save unnecessary handling of a piece of wood; a further important object is to provide method and apparatus for chipping a slab to form a wane edge flitch, and to provide method and apparatus for chipping a slab to form a cant; another object is to provide method and apparatus which eliminates some handling of small pieces of wood in the mill; an additional object is to provide method and apparatus which eliminates labor in the processing of small pieces of wood in the mill and in addition saves material in the processing of small pieces of wood in the mill as one saw line is saved per turn of the log and therefore there is eliminated useless sawdust and, in conjunction with the elimination of the saw line there is made possible the processing of more logs per unit of time and therefore less cost for processing of a log, from a labor and handling standpoint; an additional object is to provide method and apparatus for saving labor in the handling of small troublesome pieces of wood; another important object is to provide a method and apparatus for saving in regard to handling and transfer equipment; an additional object is to provide method and apparatus so as to save on the maintenance cost on nonexistent equipment such as handling and transfer equipment; an additional object is to provide method and apparatus which simplifies the processing of wood as there is eliminated many steps in the handling of wood; another important object and advantage of the invention is to make possible a greater economic utilization of the potential in wood as the wood is converted to lumber, which is of more economic value, than wood chips; a further important object of the invention is to provide method and apparatus which requires less initial investment for handling small logs and pieces of wood than presently available equipment, either from one source or a combination of many sources; another important object and advantage of the invention is to provide method and apparatus for salvaging useable lumber and useable wood chips, without waste such as sawdust from a sawline, from mismanufactured pieces of lumber having one or two curved surfaces in conjunction with one or more flat surfaces; an additional object is to provide an apparatus for moving the chipper head and part of the anvil for ensuring the making of useful chips from the piece of wood; another important object is to provide method and apparatus for chipping a piece of wood to substantially simultaneously form two flat surfaces on a processed piece of wood; and, an additional important object and advantage is to provide apparatus, of the same basic design, and which apparatus can be made in various sizes to handle logs of a wide range of diameter from approximately 3 inch in diameter through approximatey 48 inches in diameter.

These and other important objects and advantages of the invention will be more particularly brought forth upon reference to the accompanying drawings, the detailed description of the invention and the appended claims.

Figure 3:
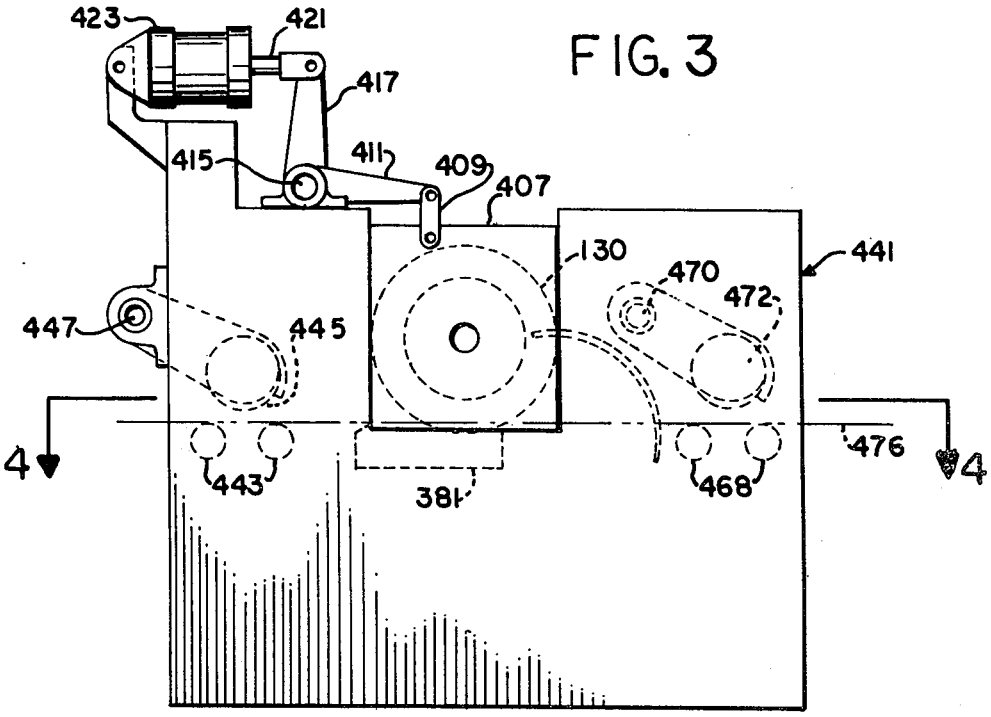
FIG. 3 is a schematic side elevational view of the harvester machine illustrating the chipper head, the means for raising and lowering the chipper head with respect to the bed of the harvester machine, and the front and back lower feed rolls and the upper press rolls.
Figure 4:
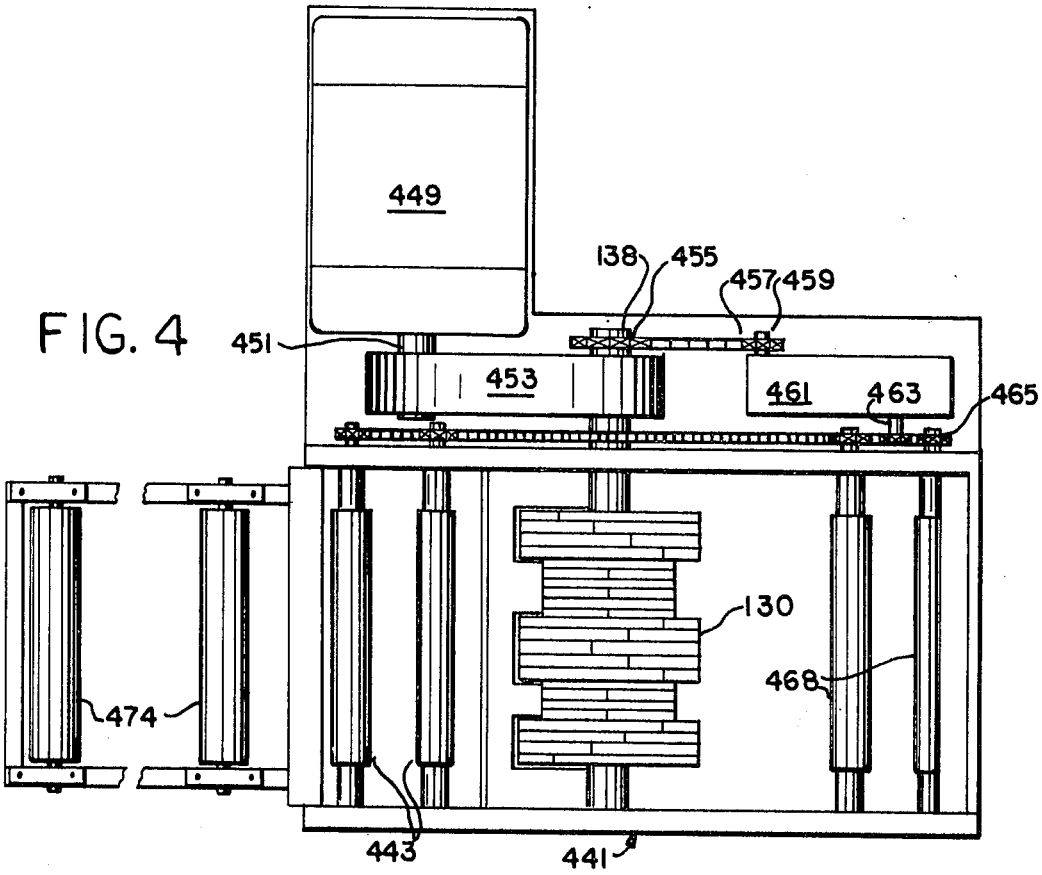
Figure 5:
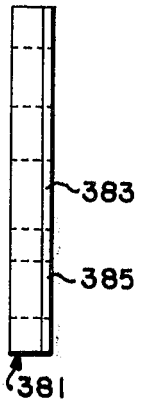
Figure 6:
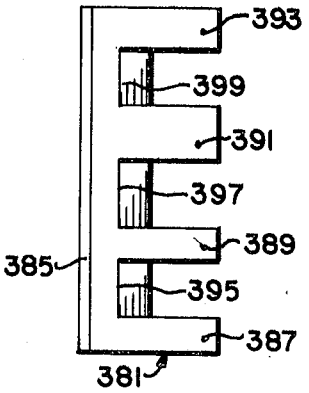
Figure 7:
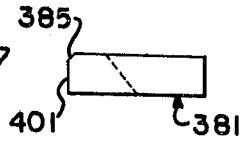
Figure 22:
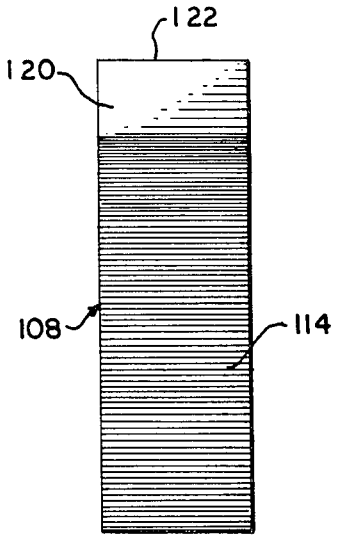
Figure 23:
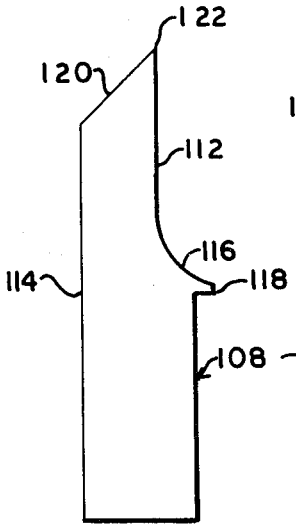
Figure 24:
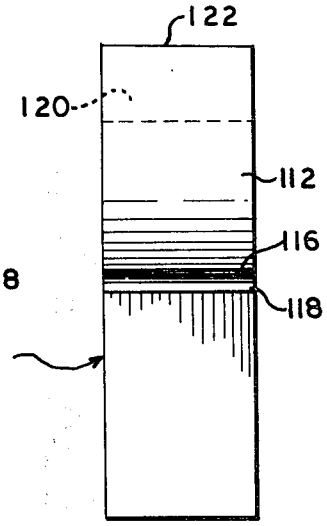
Figure 25:
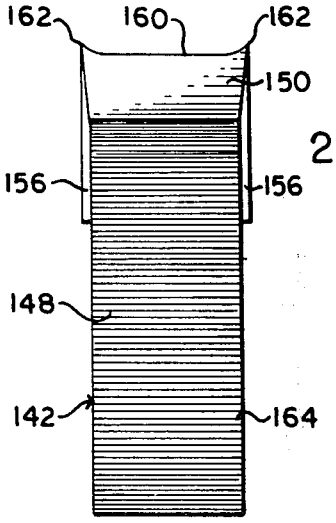
Figure 26:
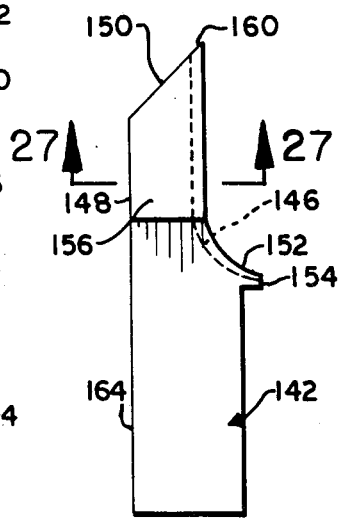
Figure 27:
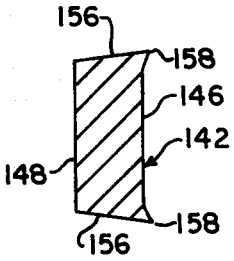
Figure 28:
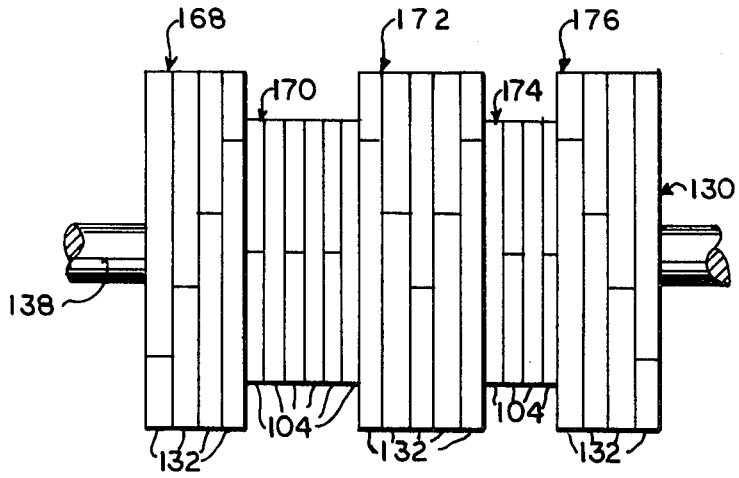
Figure 29:
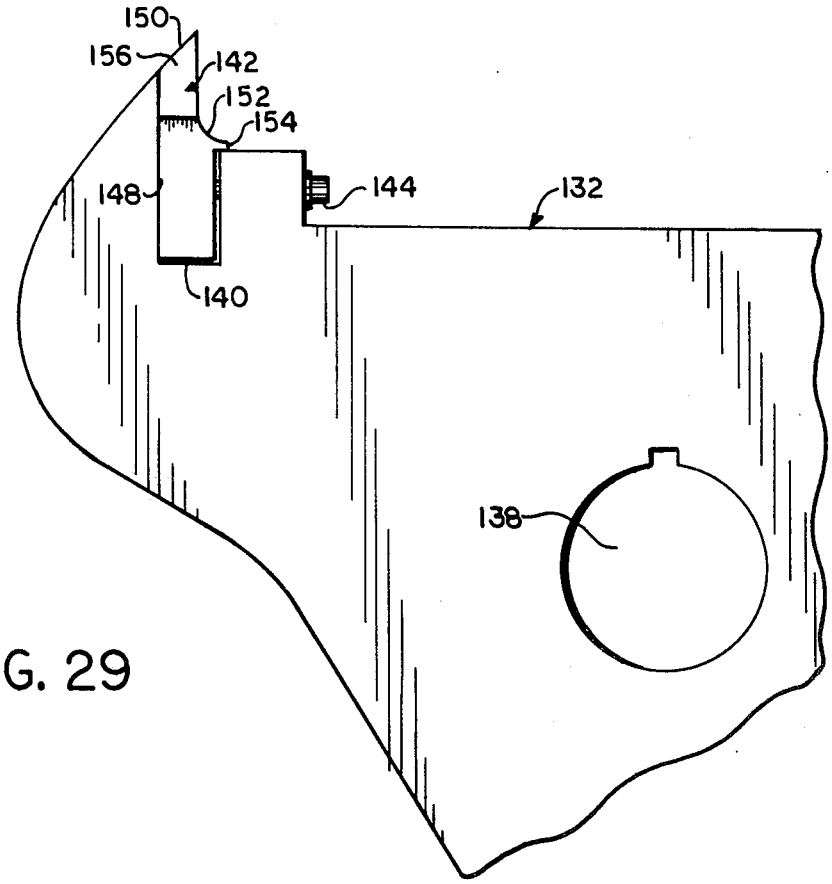
Figure 30:
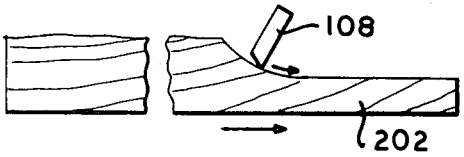
Figure 32:
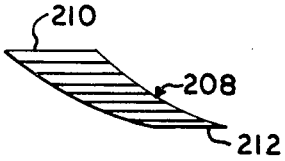
Figure 33:
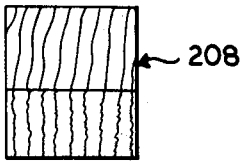
Figure 34:
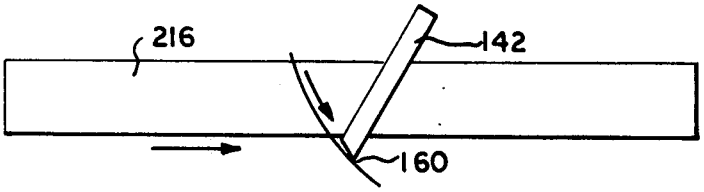
Figure 35:
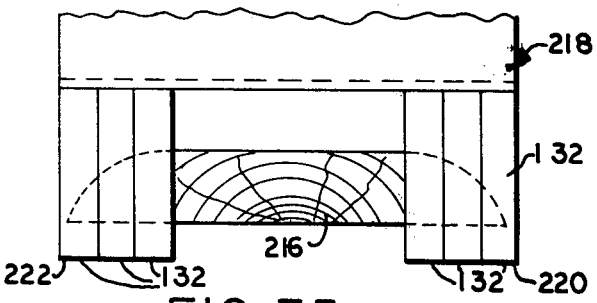
Figure 36:
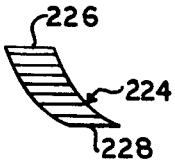
Figure 37:
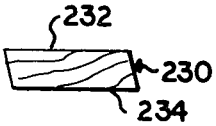
Figure 38:
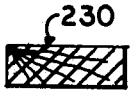
Figure 58:
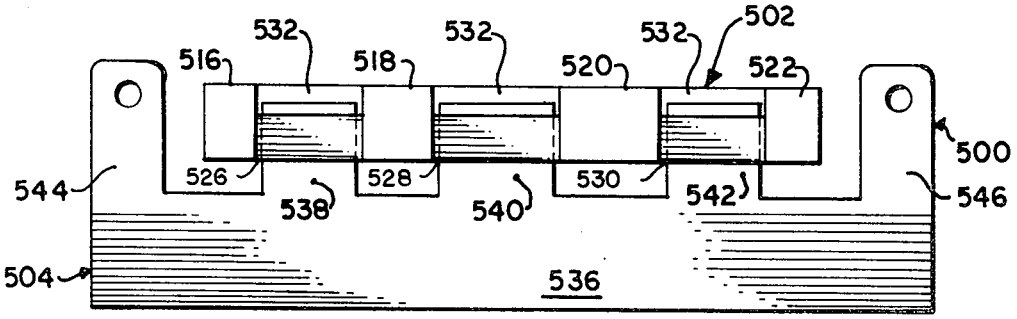
Figure 60:
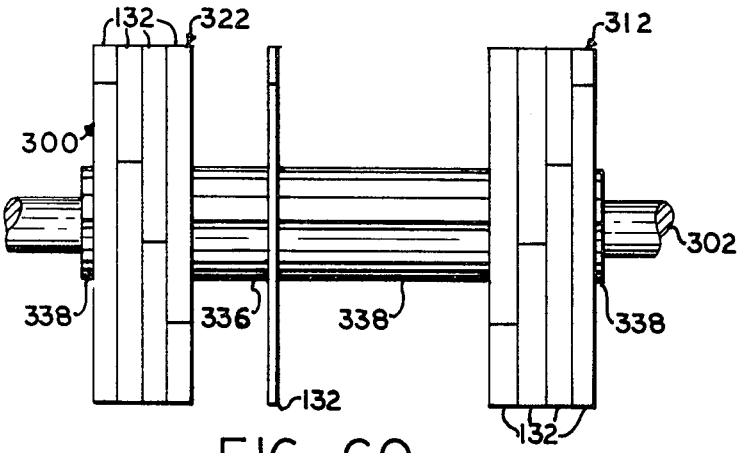
Figure 59:
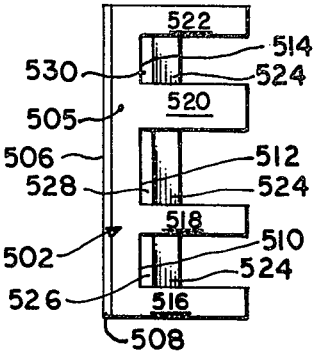
Figure 61:
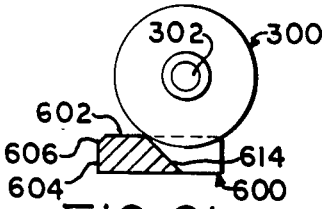
Figure 62:
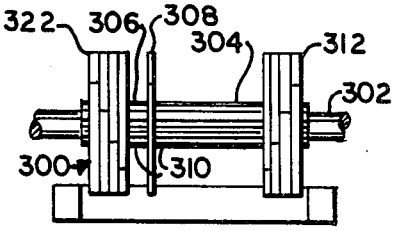
Figure 63:
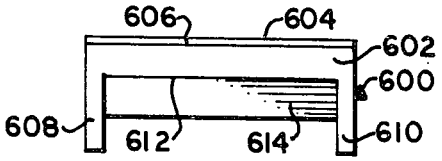
Figure 64:
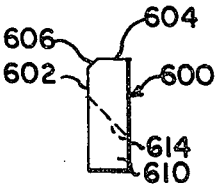

FIG. 4 taken on line 4—4 of FIG. 3, is a schematic lateral horizontal cross-sectional view illustrating the feed table, the lower feed rolls, the chipper head and anvil, and the motor for driving the chipper head and the feed rolls;

FIG. 5 is a front elevational view looking at the front face of the anvil;

FIG. 6 is a plan view looking down on the anvil;

FIG. 7 is a side elevational view of the anvil;

FIG. 8 is a side elevational view of the combination of the chipper head and the anvil of the harvester machine;

FIG. 9 is a rear elevational view of the combination of the chipper head and anvil of the harvester machine;

FIG. 10 is a front elevational view of the combination of the chipper head and the anvil of the harvester machine;

FIG. 11 is a schematic side elevational view of the mechanical linkage for moving the chipper head and the anvil relative to each other;

FIG. 12 is a rear elevational view of the mechanical linkage, in the harvester machine, for moving the chipper head and the anvil relative to each other;

FIG. 13 is a plan view illustrating the mechanical linkage for moving the chipper head, relative to the anvil;

FIG. 14 is a plan view looking at the anvil of the salvage machine;

FIG. 15 is a side elevational view of the anvil of the salvage machine;

FIG. 16 is a front elevational view of the anvil of the salvage machine;

FIG. 17 is an elevational view of the chipper head of the salvage machine;

FIG. 18 is a side elevational view of the chipper head of the salvage machine and illustrates the chipping knives in a spiral relationship;

FIG. 19 is a schematic side elevational view of the combination of the chipper head and anvil of the salvage machine;

FIG. 20 is a rear elevational view of the combination of the chipper head and anvil of the salvage machine;

FIG. 21 is a fragmentary side elevational view of a chipper segment, illustrating the means for positioning the chipping knife, of a chipper had of the salvage machine;

FIG. 22 is a rear elevational view of a chipping knife as used for climb cutting or climb milling a piece of wood, i.e., cutting into the surface of a piece of wood, and which knife is used in the salvage machine and is also used for climb milling in the harvester machine;

FIG. 23 is a side elevational view of the knife of FIG. 22 and at the upper apex illustrates the annular cutting edge of this knife when the knife is positioned in the chipper head;

FIG. 24 is a front elevational view of the chipping knife of FIG. 22;

FIG. 25 is a rear elevational view of a chipping knife as used in the harvester machine and illustrates the wider face of the chipping knife as compared with the narrower back and which chipping knife is used for rotary milling of the piece of wood, i.e., cutting through the body of the piece of wood, and which chipping knife can be used in the harvester machine;

FIG. 26 is a side elevational view of the chipping knife of FIG. 25 and at the apex illustrates the annular cutting edge of the chipping knife when the chipping knife is positioned in the chipper head;

FIG. 27, taken on line 27—27 of FIG. 26, is a lateral cross-sectional view of the chipping knife and at the two right edges or corners there is illustrated the two radial cutting edges of this chipping knife when this chipping knife is placed in the chipper head;

FIG. 28 is an elevational view of a harvester head assembly;

FIG. 29 is a fragmentary illustration of a chipper head segment for rotary milling and illustrates the means for holding the chipping knife;

FIG. 30 is a schematic side view of a chipper knife used for climb cutting or climb milling a slab;

FIG. 21 is a schematic illustration of a slab and illustrates, by broken line, the portion of the slab removed by climb cutting and illustrates by solid line the resulting wane edge flitch;

FIG. 32 is a side view of a wood chip produced by climb cutting or climb milling of a piece of wood;

FIG. 33 is a plan view of a wood chip produced by climb cutting or climb milling;

FIG. 34 is a schematic side elevational view of a chipper knife rotary milling a piece of wood;

FIG. 35 is a schematic illustration of the rotary milling of a flitch by a chipper head and which chipper head is only fragmentarily illustrated;

FIG. 36 is an elevational view of a series of wood chips produced by the rotary milling of a piece of wood;

FIG. 37 is a side elevational view of a wood chip produced by the rotary milling of wood;

FIG. 38 is an end view of a wood chip produced by the rotary milling of a piece of wood;

FIG. 39 is the schematic illustration of the positioning and movement of a log on a head rig and which log is moved past a rotary milling chipping head and a saw;

FIG. 40 is a schematic rear view of the head rig, log, band saw and rotary chipper head for removing a peripheral portion of the log by a rotary milling action of the chipper head and to form a wane edge clitch;

FIG. 41 is a front view of the head rig, the log, the chipper head for rotary milling the peripheral portion of the log, and the band saw for sawing the log to form a wane edge flitch;

FIG. 42 is a rear view or an outfeed view of an apparatus having a chipper head for rotary milling a mismanufactured piece of lumber and which mismanufactured piece of lumber has three flat sides and a curved side;

FIG. 43 is a front view or an infeed view of a chipper head for rotary milling a mismanufactured piece of lumber to form a useful piece of lumber and which mismanufactured piece of lumber has three flat sides and a curved side;

FIG. 44 is a schematic side elevational view illustrating the chipper head and feed rolls and fence rolls for rotary milling a piece of wood;

FIG. 45 is an end view of a mismanufactured piece of lumber having three flat sides and a curved side and by means of a phantom line illustrates that portion of the mismanufactured piece of wood which will be removed as wood chips;

FIG. 46 is an end view illustration of a useful piece of lumber manufactured from the mismanufactured piece of lumber from FIG. 45;

FIG. 47 is an end view of a mismanufactured piece of lumber having three flat sides and a curved side, and shows by means of a broken line that portion of the mismanufactured piece of lumber which will be removed as chips;

FIG. 48 is an end view of a useful piece of lumber manufactured from the mismanufactured piece of lumber of FIG. 47;

FIG. 49 is an end view of a mismanufactured piece of lumber having three flat sides and a curved side, and illustrates by means of a broken line that portion of the lumber which will be removed as wood chips;

FIG. 50 is an end view of a useful piece of lumber manufactured from the mismanufactured piece of lumber of FIG. 49;

FIG. 51 is a schematic illustration of a chipper head used in a harvester machine and which chipper head is used for rotary milling only;

FIG. 52 is a schematic illustration of a chipper head used in a harvester machine and which chipper had may be used for both rotary milling of a piece of wood and for a combination of rotary milling and climb milling of a piece of wood;

FIG. 53 is an end elevational view of a chipper head used in rotary milling and which chipper segments are arranged in a spiral configuration so that the outside chipper knives first contact the piece of wood being chipped and therefore remove the wood as chips as if the piece of wood were being peeled;

FIG. 54 is a front elevational view of the chipper head having the chipping knives arranged in a spiral as illustrated in FIG. 53;

FIG. 55 is a schematic side elevational view illustrating a chipper head, an anvil having a fixed anvil part and a movable anvil part, and means for moving the chipper head;

FIG. 56 is a rear elevational view of the chipper head, the anvil having the fixed anvil pat and the anvil having the movable anvil part with the chipper head connected to the moviable anvil part;

FIG. 57 is a rear elevational view of the movable anvil part of FIGS. 55 and 56;

FIG. 58 is a rear elevational view of the anvil having the fixed anvil part and the movable anvil part and illustrates the movable anvil part fitting with the fixed anvil part;

FIG. 59 is a plan view of the fixed anvil part and illustrates the slots in the fixed anvil part through which the movable anvil part moves;

FIG. 60 is an elevational view of a chipper head used in a harvester machine for rotary milling flitches and illustrates a chipper for splitting or dividing said flitches into two cants;

FIG. 61 is an end elevational view of the chipper head of FIG. 60 and a cross-sectional view of the anvil used in combination with the chipper head;

FIG. 62 is a rear elevational view of the combination of the chipper head of FIG. 60 and the anvil associated with said chipper head;

FIG. 63 is a plan view of the anvil of FIG. 61 and 62;

FIG. 64 is a side view of the anvil of FIGS. 61, 62 and 63;

FIG. 65 is a side elevational view of the chipper head and the anvil having a stationary anvil part and a movable anvil part, as used in the havester, see FIGS. 55, 56, 58 and 59, and illustrates the movable anvil part as moving in the guide slot of the stationary anvil part, and further illustrates the movable anvil part in a lower position so that the chipper head is used in conjunction with the stationary anvil part;

FIG. 66 is a side elevational view of the anvil of FIG. 65 and illustrates the movable anvil part and the chipper head in a raised position or elevated position so that the chipper head is used in conjunction with the movable anvil part;

FIG. 67 is a schematic view of a chipper head used in a harvester machine and illustrates a fixed part of the chipper head on a shaft and illustrates a movable part of the chipper head on said shaft so that the spacing between the fixed part of the chipper head and the movable part of the chipper head may be varied;

FIG. 68 is a schematic illustration of a chipper head, for rotary milling, as used in a harvester machine, and illustrates a chipper knife segment for splitting or dividing a cant and illustrates a first movable part of the chipper head, on the left, and illustrates a second movable part of the chipper head, on the right, for moving the two parts of the chipper head so as to have a different spacing between the two parts of the chipper head and the chipper head used for splitting or dividing a cant, and with provision for moving that left part of the chipper head so as to be next to and adjacent the splitter chipper head so in effect to have two rotary milling heads on the shaft;

FIG. 69 is a schematic side elevational view of a rotary milling chipper head and a shotgun carriage for moving a piece of wood such as a log past the rotary milling chipping heads;

FIG. 70 is an end elevational view of the apparatus of FIG. 69 and illustrates the two spaced apart rotary milling chipping heads for milling a log so as to form a flitch having two flat sides and two curved sides from said log;

FIG. 71 is an end view of a wane edge cant formed from the log and apparatus of FIG. 70 and which wane edge cant has two flat sides and two curved sides;

FIG. 72 is an end view of a wane edge cant having four flat sides and four curved sides;

FIG. 73 is an end view of a square cant;

FIG. 74 is an end view of a piece of lumber having six flat sides and which piece of lumber may be manufactured on the apparatus of FIGS. 69 and 70; and, FIG. 75 is an end view of a piece of lumber having eight flat sides and which piece of lumber may be manufactured on the apparatus of FIGS. 69 and 70.

This invention is directed to the working and processing of a piece of wood such as a slab, a flitch, or a log. There are various features of this invention. In order to more clearly follow this invention and the various features, a brief outline of the applicable drawings to a certain feature is presented. For example, there is the salvage machine, and there is the harvester machine. The salvage machine and the harvester machine use the same frame and basic structure. The main difference between the salvage machine and the harvester machine resides in the chipper head and the anvil.

The salvage machine is designed to climb cut or climb mill a flitch or a slab of wood. The salvage machine removes the undesirable wood in the form of wood chips. With a slab, the salvage machine produces wood chips and a flitch. With a poor quality flitch, the salvage machine produces wood chips and a high quality flitch. In the drawings, FIGS. 1, 3, 4, 12 through 24 and 30 through 33 are applicable to the salvage machine.

The harvester machine is designed to climb cut or to climb mill and to rotary mill a slab, a flitch, mismanufactured lumber and a log. With a slab, the harvester machine removes the undesirable wood as chips and produces a cant. With a flitch, the havester machine removes the undesirable wood as chips and produces a cant. With mismanufactured lumber, the harvester machine removes the undesirable wood as chips and produces a higher quality lumber. With a log, the harvester machine removes the undesirable wood as chips and produces a flat surface on the log. In the drawings the figures applicable to the harvester machine are FIGS. 2 through 13, 22 through 29, 34 through 38 and 51 through 75.

In the salvage machine and in the harvester machine there is a combination of a chipper head and an anvil. In the drawings the figures applicable to this combination of chipper head and anvil are FIGS. 3 through 21, 55 through 56, 61, 62, 65 and 66.

The harvester machine may be used in conjunction with a saw and a head rig. The harvester machine removes the outer portion of the log so as to produce an outer flat surface while the saw cuts more toward the center of the log so as to produce a second flat surface and, in effect, to produce a wane edge flitch. In addition, with the harvester machine chipping the undesirable wood from the outer portion of the log, there is eliminated one saw line and what would have been a waste product sawdust now becomes a useful product wood chip. In the drawings the figures applicable to the combination of the saw, harvester machine and head rig are FIGS. 39 through 41.

With mismanufactured lumber, there is produced a low quality or non-commercially useable lumber. This is an economic waste. For example, in the manufacture of lumber maybe the manufacturer wanted to produce a 2 by 4 inches but the raw material was not sufficient to produce this 2 by 4 inches and there was produced mismanufactured lumber which had no commercial value. With the subject of this invention, it is possible to remove the undesirable wood as wood chips from this mismanufactured lumber and to produce, say from a mismanufactured 2 by 4 inches, useful wood chips and a 1 by 2 inches or a 2 by 2 inches or a 2 by 3 inches or a 1 by 4 inches. In the drawings, the figures applicable to the reworking of mismanufactured lumber are FIGS. 42–50.

With this invention, a variation of the harvester machine may have movable chipper heads on the drive shaft. One of the chipper heads may be movable on the drive shaft or both of the chipper heads may be movable on the drive shaft for accommodating different size flitches. In the drawings, the figures applicable for movable chipper heads are FIGS. 40–43, 67 and 68.

In combination with the movable chipper heads on the drive shaft of the harvester machine, there may be used a splitter head. For example, a wane edge flitch may be fed to the harvester machine and the movable chipper had positioned on the drive shaft so as to remove the wane. The splitter head may be used to divide the flitch into two cants. In the drawings, the figures applicable to the splitter head are FIGS. 60, 62 and 68.

The harvester machine may also be used in conjunction with a head rig. In fact, there are two harvester machine chipper heads which act substantially simultaneously on a log or a wane edge cant to remove the undesirable wood to make a more highly processed or more highly worked piece of lumber. In the drawings the figures applicable to the two harvester machine chipper heads acting substantially simultaneously on a log or a wane edge cant are FIGS. 69–75.

Figure 1:
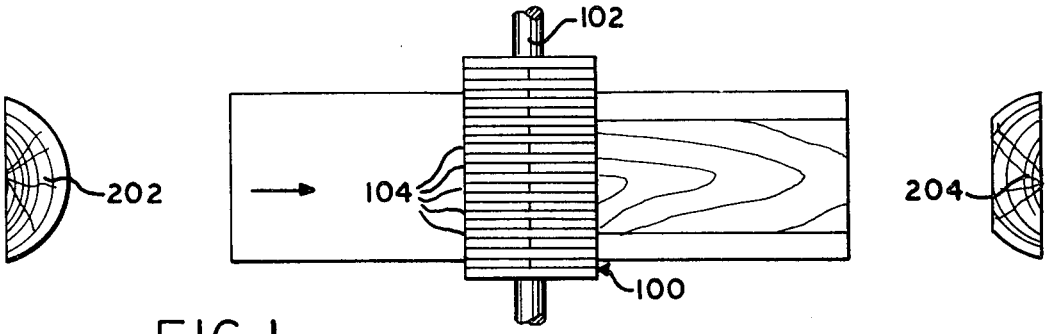
FIG. 1 is a schematic illustration of a slab of wood, on the left, being processed by the salvage machine with a climb cut or a climb mill to make a wane edge flitch, on the right.

With reference to the salvage machine and FIGS. 1, 14–24 and 30–33, in FIG. 1 the left illustration of the wood may be considered to be a log or a slab, for illustrative purposes. The salvage machine removes the undesirable wood as wood chips to produce a log having a flat surface or a wane edge flitch, see the right illustration of the piece of wood. With a flitch, the salvage machine will remove that portion of the wood adjacent to the already existing flat surface to form another flat surface. The salvage machine saves a saw line and removes the undesirable wood as wood chips and what would have been a waste product sawdust is now a useful product wood chips. Further, the salvage machine, by removing undesirable wood as wood chips, opens the face of the wood to further inspection before additional processing of the wood. By opening the face of the wood to further inspection, it is possible to more carefully grade the wood. In many instances, what may have appeared to be a low quality flitch or slab, by opening to more complete inspection, may turn out to be a higher quality flitch and therefore can be processed to a higher quality piece of lumber of greater economic value.

The chipper head 100 of the salvage machine comprises a mounting shaft 102 and a chipper head segment 104. The chipper head segment 104 has a knife mounting throat 106 for mounting the salvage machine chipping knife 108. A setscrew 110 positions the knife 108 in the throat 106. In FIG. 18 there is illustrated a four step spiral head having chipping knives 108 at 90° angles. These chipping knives 108 are mounted on the chipper head segments 104. In FIG. 17 there is an elevational view of the chipper head 100 and a view of the alternating chipper head segments 104 at 180° angles or at right angles to each other.

In FIGS. 22 through 24 there is illustrated the salvage machine chipping knife 108. The chipping knife 108 has a face 112, a back 114, a gullet 116, a trailing edge 118 of the gullet and a heel 120 sloping from the upper part of the face to the back 114. At the junction of the face 112 and the heel 120 there is an annular cutting edge 122. With the salvage machine chipping knife 108 the annular cutting edge 122 functions to climb cut the piece of wood such as a log, a slab or a flitch.

The chipper head 100 of the salvage machine is used in conjunction with an anvil 123, see FIGS. 14 through 16. The anvil 123 will be more particularly described in a latter part of the application.

The harvester machine climb cuts or climb mills and rotary mills any piece of wood such as a log, a slab, a flitch or a mismanufactured piece of wood. With a log, the harvester machine removes an outer portion of the log to form a flat surface and thereby eliminates one saw line per head and removes the wood as wood chips and by eliminating the saw line eliminates the manufacture of a waste product sawdust and manufactures a useful product wood chips. With a piece of wood having one flat surface such as a slab, a flitch or a mismanufactured piece of lumber, see FIG. 2, and FIGS. 42 through 50, the harvester machine forms up to three flat surfaces. With a slab, the harvester machine will form three flat surfaces and thereby eliminate three saw lines. What would have been waste product sawdust is now converted into a useful product wood chips. By the elimination of one or more saw lines there is eliminated transfer and handling equipment. Inherent with the elimination of transfer and handling equipment is the saving on maintenance. In conjunction with the elimination of one or more sawlines there is eliminated small pieces of wood and chunks of wood, which are a nuisance and quite often the cause of trouble in a sawmill. With a wane edge flitch, a harvester machine will eliminate two saw lines as it removes the wane, see FIG. 35. With mismanufactured lumber, see FIGS. 42 through 50, the harvester machine eliminates one saw line.

A harvester machine chipper head 130 is illustrated in FIG. 28 and a harvester machine chipper segment 132 is illustrated in FIG. 29. In FIG. 51 there is illustrated a harvester machine chipper head 134, and in FIG. 52 there is illustrated a harvester machine chipper head 136.

A harvester machine chipper head, such as 130, comprises a shaft 138 and a plurality of harvester machine chipper segments 132 and a plurality of salvage machine chipper head segments 104.

The harvester machine chipper segments 132 have a knife mounting throat 140, a harvester machine chipping knife 142 and a setscrew 144 for positioning the harvester machine chipping knife 142 in the harvester machine throat 140.

The harvester machine chipping knife 142 comprises a face 146, a back 148, and a heel 150 sloping downward from the outermost part of the face 146 to the outermost part of the back 148. Also, the harvester machine chipping knife 142 comprises a gullet 152 and a trailing edge 154. In addition, the harvester machine chipping knife 142 comprises sides 156. In FIGS. 25 through 27 it is seen that the sides on the face are wider than the sides at the back or in going from the face to the back, the sides taper inwardly. Also, it is seen that the main body of the face 146 is recessed with respect to the leading forward edge of the sides 156. As a result, there is produced a radial cutting edge 158. The sides 156 may be ground away so as to always have a sharp radial cutting edge 158. At the junction of the heel 150 and the main body of the face 146 there is produced an annular cutting edge 160. In addition, because of the sides 156 being wider at the front or face than at the back, the annular cutting edge 160 has spurs 162. As is seen in FIGS. 25 through 27 the harvester machine chipping knife 142 has three cutting edges. The cutting edge 160 is considered to be an annular cutting edge and cross mills a piece of wood; and, the two-cutting edges 158 are considered to be radial cutting edges and rotary mill a piece of wood.

On the back 148 of the harvester machine chipping knife 142 there are serrations 164 to assist in positioning the chipping knife in the harvester machine chipping segment 132. The trailing edge 118 and the salvage machine chipping knife 108 and the trailing edge 154 and the harvester machine chipping knife 142 there is provided a means for protecting the throat of the chipper head segment so that dust, small particles of wood and the like do not get into the throat and also to ensure that the wood chips move out of the chipper head and away from the chipper head so that more wood may be chipped.

In the harvester machine chipper head 130 there is a first assembly 168 of harvester machine chipping knives 142, a second assembly 170, of salvage machine chipping knives 108, a third assembly 172 of harvester machine chipping knives 142, a fourth assembly 174 of salvage machine chipping knives 108 and a fifth assembly 176 of harvester machine chipping knives 142. These are all mounted on the same shaft 138. The second assembly 170 is between the outer first assembly 168, and the inner third assembly 172 and the fourth assembly 174 is between the third assembly 172 and the outer fifth assembly 176.

In the harvester machine chipper head 136 the assemblies 168, 170, 172, 174 and 176 are mounted on the shaft 138. Also, mounted on the shaft 138 is a sixth assembly 178 comprising harvester machine chipping knives 142. It is seen that the sixth assembly 178 is spaced apart from the fifth assembly 176 by means of a spacer 180.

In FIG. 52 it is seen that the harvester machine chipper head 136 comprises assemblis 168, 172, 176 and 178 having harvester machine chipping knives 142 to produce cross milled chips. Again, in rotary milling, the chipping knives or chipper head cuts completely through the piece of wood being processed or chipped so as to produce the cross milled chips. Also, the harvester machine chipper head 136 comprises the assemblies 170 and 174 having the salvage machine chipping knives 108 for climb milling a piece of wood.

In FIG. 51 there is illustrated the harvester machine chipping head 134 on the shaft 138. The harvester machine chipping head 134 has a first assembly 182, a second assembly 184 and a third assembly 186. The assemblies 182, 184 and 186 have only harvester machine chipping knives 142. Further, the first assembly 182 is spaced apart from the second assembly 184, on the shaft 138, by means of spacer 188. The second assembly 184 is spaced apart from the third assembly 186 on the shaft 138 by means of spacer 190. With the harvester machine chipping head 134 it is possible to process a wane edge flitch to give cants of two different widths and different thicknesses.

With the harvester machine chipper head 136 it is possible to process a flitch, by means of the assemblies 176 and 178, to give a cant and, it is possible to process at least two different slabs or flitches by means of the combination of assemblies 172, 174 and 176 or by means of the combination of the assemblies 168, 170 and 172 to give cants of different widths but of the same thicknesses.

From the chipper heads 130 of FIG. 28, 134 of FIG. 51 and 136 of FIG. 52, it is seen that many combinations of climb milling and rotary milling chipping knives can be arranged to process slabs, flitches, mismanufactured lumber and logs to higher valued lumber.

Figure 2:
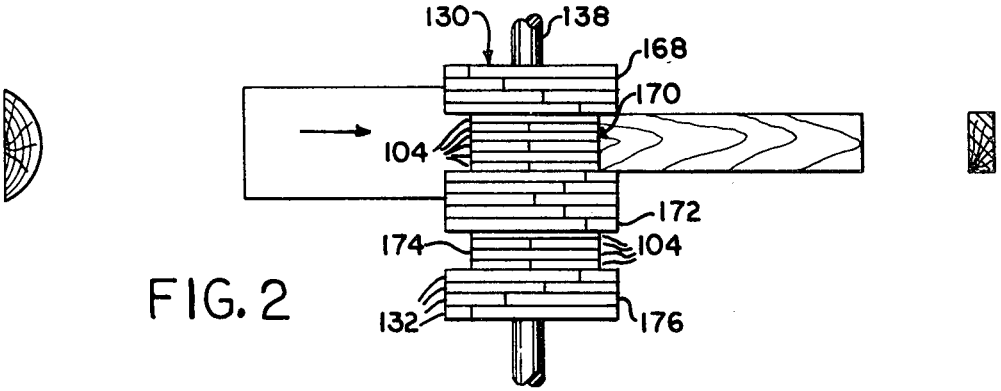
FIG. 2 is a schematic illustration of a slab of wood, on the left, being processed by a harvester machine in a climb cut or a climb mill action and also in a rotary mill action to form a cant, on the right.

In FIGS. 53 and 54 there is illustrated a harvester machine chipper head 200 having shaft 138. The chipper head 200 has harvester machine chipping segments 132 and with each segment 132 having three harvester machine chipping knives 142 at 120° spacings. In the chipper head 132 it is seen that the chipping knives 142 are in a spiral. In this spiral I have found that it is of value to have the outermost knife to be the first knife to contact the piece of wood. Likewise, the second most outer knife to be the second knife to contact the wood and the third outermost knife to be the third knife to contact the wood. This is more particularly brought out with respect to FIG. 54. In FIG. 53 it is seen that the first knife 142 is closest to the observer, the second knife 142 is next closest to the observer and likewise with the remaining knives. In FIG. 2 it is seen that the knives in the third assembly 172 are so arranged that the outermost knives first strike the piece of wood, then the second outermost knives strike the piece of wood and the inner knife is the last one to strike the piece of wood. Also, in FIG. 2 it is seen that in the assemblies 168 and 176 that the outermost knives are first to strike the piece of wood while the innermost knives are the last to strike the piece of wood.

Figure 31:
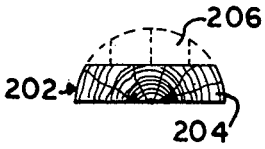

In FIGS. 30 through 33, there is illustrated the climb cutting or climb milling of a slab 202 with the salvage machine chipping knife 108. In FIG. 31 there is illustrated an end elevational view of the slab 202 after the step of climb milling has taken place so as to produce a wane edge flitch 204. The cross hatched area 206 illustrates that portion which was removed as wood chips by the climb milling action of the salvage machine chipper knife 108. In FIG. 32 there is illustrated a side elevational view of a chip 208 as produced by a climb milling action. It is seen that the upper or leading edge 210 of the chip 208 is thicker than the following or trailing edge 212. The reader can readily visualize the reason for this. The chipper head rotates in the direction of travel of the movement of the piece of wood, i.e., slab 202. When the chipper knife 108 contacts the piece of wood, the chipper knife may be substantially at a right angle or near a right angle to the surface of the wood 202. As the chipper head rotates with the direction of travel of the piece of wood, the angle at which the chipper knife 108 cuts the piece of wood continuously changes until the chipper knife is substantially parallel with the grain of the piece of wood, instead of being substantially at right angles with initial contact to the piece of wood, and therefore the trailing edge, due to the parallel situation, is thinner and of less width than the leading edge 210 due to being cut at substantially a right angle.

In FIG. 33 there is a plan view looking down on the chip 208 and showing the variation in length of the separate areas of the wood chip due to the angle of cutting with the chipper knife 108 on the piece of wood.

In FIG. 34 there is illustrated the cutting of a piece of wood 216, i.e., a wane edge flitch, by means of a harvester machine chipping knife 142. The harvester machine chipping knife 142 is mounted in a chipper head 218 having a number of harvester machine segments 132 in a first assembly 220 and a spaced apart second assembly 222. There is produced from the wane edge flitch 216 a cant.

In FIG. 34 it is seen that the chipping knife 142 rotary mills so as to completely cut through the piece of wood 216. Also, in FIG. 34 it is seen that the annular cutting edge 160 of the cutting knife 142 is at substantially the same angle with respect to the grain of the piece of wood through the entire cut of the piece of wood by the cutting edge 160. Therefore, there is produced a series of chips 224 and in which series of chips the leading edge 226 is substantially the same length as the trailing edge 228. In FIG. 37 there is illustrated a side view of an individual chip of the series of chips 224 of FIG. 36. It is to be realized that in the series of chips 224 that the chipping knife 142 continues to break apart the separate chips from the series of chips due partially to the gullet 152. Also, in FIG. 37 the individual chip 230 has a leading edge 232 and a trailing edge 234. The leading edge 232 is of substantially the same length as the trailing edge 234.

In FIG. 38 there is illustrated an end view of the chip 230.

The chip 230 is of a more uniform length than the chip 208. In other words, the rotary milled chip is of a more uniform length than a climb milled chip. As a result, with the digestion of a wood chip in a digester, the fiber length of the resulting cellulose fiber is of more uniform length from the rotary milled chip 230 as compared with the climb milled chip 208.

In FIGS. 39, 40 and 41, there is illustrated the combination of a head rig and a harvester machine chipper head or the combination of a carriage, a saw and a harvester machine chipper head. The carriage 236 comprises a platform 238 mounted on wheels 240 which ride on rails 242. The carriage 236 supports a log 244 which is moved past a band saw 246 and a harvester machine chipper head 248.

As is illustrated in these figures, the harvester machine chipper head 248 rotary mills the exterior surface of the log 244 so as to rotary mill the surface of the log and to produce cross milled wood chips from this surface and to produce a flat surface 245. Then, the saw 246 cuts into the log 244 so as to produce a second flat surface 247 and a wane edge flitch 250. Prior to this invention, the outer part of the log 244 would have been sawed to make a slab. In the sawing of the log 244 to make the slab there would have been produced a waste product sawdust. The slab would have been burned or, possibly, chipped to make wood chips. With my invention, the harvester machine chipper head 248 removes the exterior portion of the log as useful wood chips and eliminates one saw line and thereby eliminates the manufacture of the waste product sawdust. What would have been the waste product sawdust is now an economically valuable useful wood chip.

As is readily comprehended by the reader, the saving of a saw line decreases the handling of the log 244 and thereby increases the production. More particularly, with the prior methods and prior equipment, the outer portion of the log would have been removed as a slab. Then, the carriage would have been returned, the log advanced on the ways of the carriage and the carriage once again moved past the saw 246 to make the wane edge flitch 250. In other words, there would have been two passes past the saw 246 to make the wane edge flitch 250 instead of one pass to make the wane edge flitch. And also, there would have been produced the waste product sawdust instead of the economically valuable useful wood chips. With my invention, there is the saving with one log four passes of the carriage 236 and the log 244 past the saw 246 and also the saving of four saw lines.

In FIGS. 42 through 50, there is illustrated the use of the harvester machine chipper head to process mismanufactured lumber to make economically valuable wood chips and economically valuable lumber.

In FIG. 42 there is illustrated a mismanufactured 2 by 4 inches 254. The mismanufactured 2 by 4 inches has a flat surface 256, a flat surface 258 and a flat surface 260. The flat surfaces 258 and 260 are joined by a curved surface 262.

The apparatus for processing the mismanufactured 2 by 4 inches, 254, comprises a harvester machine chipper head, fence rolls 266 and support rolls 268. From the mismanufactured lumber 254, see FIGS. 42 through 46, it is seen that that portion of the wood near the surface 262 and between the sides 258 and 260 is removed so that the, essentially a waste product, mismanufactured lumber 254, a 2 by 4 inches, is processed and transformed into useful wood chips and valuable lumber 270, a 1 by 4 inches.

In FIGS. 47 and 48, there is illustrated a mismanufactured piece of lumber 272, a 2 by 4 inches, having a flat side 274, a flat side 276 and a flat side 278. The flat sides 274 and 276 are joined by a curved side 280. With the rotary milling of that portion of the mismanufactured 2 by 4 inches, 272, near the curved surface 280 there is produced useful wood chips and a valuable piece of lumber, a 2 by 3, identified by reference numeral 282, see FIG. 48.

In FIGS. 49 and 50 there is illustrated a mismanufactured 2 by 4, 284 having a flat side 286, a flat side 288 and a flat side 290. The flat sides 286 and 288 are joined by a curved portion 292. With the rotary milling of that part of the wood near the curved portion 292, there is produced useful wood chips and useful lumber, a 2 by 2 inches, identified by reference numeral 294.

Another feature of this invention is the chipper head moving toward and away from the piece of wood being chipped. There are many variations of the movement of the chipper head, see FIGS. 40 through 43, 60 through 62 and 67 through 70. The chipper head is mounted on a shaft. The chipper head and shaft may move together toward the piece of wood and away from the piece of wood, see FIGS. 40 through 43.

The chipper head is mounted on a shaft and the chipper head may move longitudinally on the shaft. In this regard see FIGS. 60 through 62, 67 and 68.

There may be a plurality of chipper heads on the shaft. One of the chipper heads may be fixedly positioned on the shaft and the other chipper head may move longitudinally on the shaft, see FIG. 60 and also FIG. 67. Further, two chipper heads may be longitudinally movable on the shaft, see FIG. 68.

There may be three chipper heads on the shaft with two of the chipper heads fixedly positioned on the shaft and one movable on the shaft so as to be positioned adjacent to the chipper head fixedly positioned on the shaft, see FIG. 60 and FIG. 62.

There may be three chipper heads on the shaft with one chipper head fixedly positioned on the shaft and two of the chipper heads longitudinally movable on the shaft, see FIG. 68.

There may be a set of two chipper heads. Each chipper head is fixedly positioned on a shaft. A combination of a chipper head and a shaft is movable toward and away from the other combination of a chipper head and a shaft so as to accommodate various sizes of logs. In this regard see FIGS. 69 and 70.

In FIGS. 60, 61, 62 and 68 there is illustrated chipper head on a shaft and which chipper heads may be movable toward each other and away from each other. For illustrative purposes, in FIG. 68 there is illustrated a chipper head assembly 300. This chipper head assembly comprises a shaft 302. On the shaft 302 there is positioned a sleeve 304 and also a sleeve 306. Between the inner surfaces of the sleeves 304 and 306 there is a chipper head 308 or a splitter head 308. The splitter head 308 uses the chipping knife 142 having the annular chipping surface 160 and the radial chipping surface 158. There is in the sleeves 304 and 306 a slot or guide 310. There is mounted on the sleeve 304 a chipper head 312. The chipper head 312 uses the chipping knives 142. There is integral with the outer end of the chipper head 312 a thrust bearing or collar 314. As is illustrated in FIG. 68, a yoke 316, having fingers 318, connects with the thrust bearing or collar 314 so as to move the chipper head 312 longitudinally on the sleeve 304 and thereby move the chipper head 312 longitudinally on the shaft 302. A ram 320 connects with the yoke 316 for movement of the yoke and the chipper head.

Also, there is mounted on the sleeve 306 a chipper head 322. The chipper head 322 uses the chipping knives 142. On the outer or free surface of the chipper head 322 there is positioned a thrust bearing or collar 324. A yoke 326 having fingers 328 connects with the thrust bearing or collar 324. A ram 330 connects with the yoke 326 so as to move the yoke, and also to move the chipper head 322 on the sleeve 306 and thereby move the chipper head 322 on the shaft 302.

In FIG. 68 it is seen that the three chipper heads, 308, 312 and 322 may be spaced apart. Also, it is seen that the chipper head 322 may be moved next to the chipper head 308 so as in effect to have two chipper heads, a combination of 322 and 308 is one chipper head and 312 is the other chipper head. Conversely, in FIG. 68 it is seen that the chipper head 312 may be moved next to the chipper head 308 with the chipper head 322 spaced apart from the chipper head 308. Thereby, there is the equivalent of two chipper heads, the combination of 308 and 312 is one chipper head and 322 is the second chipper head. Finally, all three of the chipper heads may be moved next to each other with 322, 308 and 312 positioned adjacent to each other so as to have in effect one chipper head for completely chipping a piece of wood.

It is to be realized that in FIG. 68 that the splitter head need not be present so as to have only two movable chipper heads on the shaft 302, i.e., chipper heads 312 and 322. The two chipper heads 312 and 322 can be movable toward each other or away from each other so as to accommodate a piece of wood such as a wane edge flitch or a slab of wood. It is possible by having the two movable chipper heads 312 and 322, without the splitter head 308 present, to remove the wane on wane edge flitches so as to process the wane edge flitch to a useful cant. With the splitter head 308 present, the wane on a wane edge flitch can be removed and the splitter head 308 can divide the wane edge flitch or the resulting cant into two smaller cants.

Also, from FIG. 68 it can be seen that the splitter head 308 need not be present and that the chipper head 322 can be fixed. Therefore, only the chipper head 312 moves on the shaft 302. With this arrangement, the wane of a wane edge flitch is removed to form a useful cant.

In FIG. 60 there are chipper heads 322, 308 and 312 fixedly positioned on a shaft 302 by means of sleeves 336 and 338. The chipper head 308 is positioned between the sleeve 336 and the sleeve 338. The chipper head 322 is mounted on the sleeve 336 and the chipper head 312 is mounted on the sleeve 338. It is to be realized that the chipper heads 308, 312 and 322 are fixedly positioned with respect to the shaft 302 and are not longitudinally movable on the shaft 302. The knives in these chipper heads are chipping knives 142. It is possible to chip a wane edge flitch to remove the wane and to form two smaller cants. Also, it is possible to chip a wane edge flitch so as to remove the wane and to form one smaller cant. This will depend upon the width of the original flitch. Of course, it is to be realized that it is possible to chip a slab so as to form a piece of wood having three flat surfaces and a curved surface or to form two pieces of wood with each piece of wood having three flat surfaces and a curved surface.

In FIG. 67 there is illustrated a chipper head assembly 340 having a shaft 342. There is positioned on the shaft 342 a sleeve 344. The sleeve 344 has a plurality of guide slots 346 for guiding the movable chipper head 348. There is fixedly positioned on the shaft 342 five chipper heads 350, 352, 354, 356 and 358. The chipper heads 350, 354 and 358 use the chipping knives 142 so as to both radially and annularly chip a piece of wood. The chipper head 352 and the chipper head 356 use the chipping knife 108 so as to annularly chip a piece of wood. In FIG. 67 it is seen that the diameter of the chipper heads 352 and 356 is less than the diameter of the chipper heads 350, 354 and 358. Also, it is seen that th chipper head 352 is between the chipper head 350 and 354 and that the chipper head 356 is between the chipper heads 354 and 358.

The chipper head 348 uses the chipping knives 142 so as to both radially and to annularly chip a piece of wood. On the outer or free surface of the chipper head 348 there is positioned a thrust bearing or collar 360. There is also a yoke 362 having fingers 364 for gripping the thrust bearing or collar 360. A fluid actuated cylinder or ram 366 connects with the yoke 362 for moving the yoke and also for moving the chipper head 348 on the shaft 342 and on the sleeve 344.

In FIG. 67 it is seen that the chipper heads 350, 352, 354, 356 and 358 can be used for chipping a slab to form a useful cant, also can be used for chipping a wane edge flitch for forming a useful cant.

In FIG. 67 it is seen that the chipper head 348 and the chipper head 350 can be used for chipping a wane edge flitch for forming a useful cant and also, can be used for chipping a slab to form a piece of wood having three flat sides joined by a curved surface. The spacing between the chipper head 348 and the chipper head 350 can be varied to accommodate various widths of wane edge flitches and slabs.

Also, the chipper head 348 can be moved adjacent to and in contact with the chipper head 350 so as to completely chip a piece of wood.

In FIGS. 69 and 70 there is illustrated a set of two chipper heads on shafts. Each chipper head is mounted on a separate shaft. These chipper heads may be considered to be opposed to each other and to act on a piece of wood to form two flat parallel surfaces. There is a support bed 370. There is a mounting pedestal 372 for mounting a drive motor 374 which connects with a shaft 376. On the free end of the shaft 376 there is a chipper head 378 which uses the chipping knives 142. The shaft 376 and the chipper head 378 may be moved as indicated by the arrows.

Also, there is a mounting pedestal 380. On the pedestal 380 there is a motor 382 which drives a shaft 384. On the free end of the shaft 384 there is a chipper head 386 which uses the chipping knives 142. The combination of the shaft 384 and the chipper head 386 may be moved as indicated in FIG. 70. In other words, the combination of the chipper head 378 and the shaft 376 may be moved toward and away from the combination of the shaft 384 and the chipper head 386. Likewise, the combination of the shaft 384 and the chipper head 386 may be moved toward and away from the combination of the shaft 376 and the chipper head 378.

The support bed 370 has two spaced apart guide rails 390. A support carriage 392 is positioned on these guide rails 390 or guide tongues 390. The carriage 392 comprises a fluid actuated cylinder 394 having a plunger or ram 396. The fluid actuated cylinder 394 connects with a stationary gripping dog 398 having a dogging chuck 400 for gripping a piece of wood such as a log 402. The ram or plunger 396 connects with a movable gripping dog 404 having a gripping chuck 406 for connecting with a piece of wood or log 402. A cable 408 connects with both ends of the carriage 392, see FIG. 69. The cable 408 wraps around a powered drum 410. By rotating the drum 410 it is possible to move the piece of wood or log between the chipper heads 378 and 386.

In FIG. 70 it is seen that the chipper head 378 chips the log 402 to chip away the undesirable peripheral portion of the log 402 to form a flat surface 412, and that the chipper head 386 chips away the peripheral portion of the log 402 to form the flat surface 414. The flat surfaces 412 and 414 are substantially parallel to each other and on opposite sides of the log. The peripheral portion of the log chipped away by the chipper head 378 and 386 are useful wood chips. In FIG. 71 there is illustrated the wane edge cant 416 produced from the log 402, see FIG. 70, and which wane edge cant 416 has parallel flat surfaces 412 and 414. The parallel flat surfaces 412 and 414 are joined by curved surfaces 419 and 418.

The wane edge cant 416 may be positioned between the gripping dogs 400 and 406 of the carriage 392 and passed between the two chipper heads 378 and 386 to remove the wane surfaces 419 and 418 to form a wane edge cant 420 having flat surfaces 422 and 424, which are parallel to each other, and flat surfaces 426 and 428, which are parallel to each other. The flat surfaces 422 and 428 are joined by a curved surface 430. The flat surfaces 428 and 424 are joined by the curved surface 432. The flat surfaces 424 and 426 are joined by the curved surfaces 434. The flat surfaces 426 and 420 are joined by the curved surface 436. The wane edge cant 420 may be further processed by mounting between the gripping dogs 400 and 406 of the carriage 392 with the chipper heads 378 and 386 spaced closer to each other to form a square or rectangular cant 440 having four flat surfaces 442, 444, 446, and 448. The surfaces 442 and 446 are substantially parallel to each other. The surfaces 444 and 448 are substantially parallel to each other. The surfaces 442 and 446 are substantially at right angles to the surfaces 444 and 448.

Instead of forming a cant 440 having four flat surfaces it is possible to form a cant 450, see FIG. 74, having six flat surfaces, 452, 454, 456, 458, 460, and 462. In a lateral cross-sectional view of the cant 450 there are six flat surfaces in the configuration of a hexagon and with an interior angle of 120° between adjoining flat surfaces.

From the foregoing, it is seen that by positioning a log between the gripping dogs 400 and 406 it is possible to process this log to a wane edge cant and then to a cant having a plurality of flat sides such as in FIG. 75 wherein there is a cant 466 having eight flat sides and which cant in a lateral cross-sectional view appears to be in the configuration of an octgon. It is to be realized that a cant of a plurality of flat sides can be manufactured by running the log and the cant between the chipper heads 378 and 386.

In many instances, with the chipper head, there is used an anvil. The piece of wood moves between the chipper head and the anvil. As is appreciated, the chipper head upon hitting the piece of wood, tends to force the piece of wood away from the chipper head. With an anvil present, the piece of wood is restrained from moving, and the piece of wood bears against the anvil while the chipper head hits and chips the piece of wood. With a first chipper assembly there are two spaced apart chipper heads using the chipping knife 142. With a second chipper assembly there may be two spaced apart chipper heads using the chipping knife 142 and in between these two chipper heads there may be a third chipper head using the chipping knife 108. Therefore, it is necessary to have at least two basic different types of anvils for these two basic different types of chipping heads. Further, with various chipper assemblies, it is necessary to have individual anvils to accommodate the chipper heads of various diameters and various configurations.

A number of combinations of chipper heads and anvils, and anvils alone, are illustrated in FIGS. 3, 4, 5 through 16, 19, 20, 55, 56, 61, 62, 65 and 66.

In FIGS. 5 through 7, there is illustrated an anvil for use with a harvester chipper head and in FIGS. 8 through 10 there is illustrated the combination of the anvil and harvester chipper head.

In FIG. 5 there is illustrated a front view of the anvil while in FIG. 6 there is illustrated a plan view of the anvil, and in FIG. 7 there is illustrated a side view of the anvil 381. The anvil 381 is for use in combination with a harvester chipper head and comprises a main bearing surface 383, a chamfered leading edge 385 and four extended bearing surfaces 387, 389, 391 and 393. Between the extended bearing surfaces 387 and 389 there is a first front cutting edge 395. Between the extended bearing surfaces 389 and 391 there is a second front cutting edge 397; between the extended bearing surfaces 391 and 392 there is a third front cutting edge 399. Also, it is seen that between the extended bearing surfaces that the anvil slopes downwardly and backwardly from the leading edge 401 to form a support 403. The support 403 assists in extending the life of the anvil.

FIG. 8 is a side elevation view of the anvil 381 and the chipper head 130, see FIG. 28 and that part of the specification describing FIG. 28, the harvester machine chipper head 130 and the chipper knives 108 and 142. FIG. 9 is a rear view of the anvil 381 and the harvester machine chipper head assembly 130. FIG. 10 is a front view of the anvil 381 and the harvester machine chipper head assembly 130. In FIGS. 8 through 10, it is clearly brought forth that there need be the front cutting edges 395, 397 and 399 for the first chipper head 168, the third chipper head 172 and the fifth chipper head 176; and the need for the extended bearing surfaces 389 and 391 for the second chipping head 170 and the fourth chipping head 174.

In FIG. 11 there is illustrated the schematic side elevational view of a harvester machine chipper head assembly 130 and the anvil 381 and which anvil and chipper head assembly can be moved relative to each other to accommodate various thicknesses of slabs and flitches and cants. The shaft 138 and the harvester machine chipper head assembly 130 are mounted in a support housing 407. Connecting link 409 connects with the support housing 407 and also connects with a lever arm 411 of a bell crank. The bell crank comprises lever arm 411 and lever arm 413 fixedly mounted on a shaft 415. There is also fixedly connected to the shaft 415 a lever arm 417. The upper end of the lever arm 417 connects with a plunger or ram 421 of a fluid actuated cylinder 423. The lever arm 413 connects with a connecting link 425. The connecting link 425 connects with a lever arm 427 of a bell crank. This bell crank comprises the lever arm 427 and the lever arm 429. The lever arm 427 and 429 are fixedly positioned on a shaft 431. The lever arm 429 connects with a connecting link 433. The connecting link 433 connects with the anvil 381.

In FIG. 11 it is seen that when the ram or plunger 421 is extended that the lever arm 411 rotates in a clockwise direction and that the connecting link 409 moves downwardly and therefore the support housing 407 and the harvester machine chipper head assembly 130 move downwardly. To accommodate the downward movement of the harvester machine chipper head assembly 130, it is necessary to move the anvil 381 forwardly so that the cutting edges 395, 397 and 399 are moved away from the chipping knives. This is accomplished as with the rotation of the lever arm 411 in a clockwise direction, the lever arm 413 also rotates in a clockwise direction and the lever arm 427 and 429 rotate in a counterclockwise direction so as to move the connecting link 433 to the left and thereby moves the anvil 381 to the left or forwardly.

Conversely, in order to accommodate a thicker piece of wood such as a slab, a flitch or a wane edge cant, the ram or plunger 421 is retracted. The lever arm 411 rotates in a counterclockwise direction so as to elevate the connecting link 409 and the harvester chipper head assembly 130. Then, the anvil 381 must move to the right or backwardly. With the rotation of the lever arm 411 in a counterclockwise direction, the lever arm 413 also rotates in a counterclockwise direction. The connecting link 425 moves downwardly so as to rotate the lever arms 427 and 429 in a counterclockwise position. The connecting link 433 moves to the right so as to move the anvil 381 to the right or backwardly or rearwardly.

In FIG. 12 there is illustrated a rear elevational view of the support housing 407, the shaft 415, the spaced apart connecting links 409. The connecting links 409 connect with the housing 407 and also connect with a rib 435 which connects with the housing 407. Further, in FIG. 12 there is illustrated the connecting links 425.

FIG. 13 is a plan view showing the fluid actuated cylinder 423, the shaft 415, the connecting links 409, the rib 435 and the housing 407.

In FIG. 3 there is illustrated a side elevational view of a harvester machine having the movable support housing 407, the movable anvil 381 and the harvester machine chipper head 130 in the support housing 407.

The harvester machine 441 in FIG. 3 has inlet support rolls 443 and a powered feed roll 445. There is a powered shaft 447 and which powered shaft through a chain drive powers the support rolls 443 and the upper feed roll 445, see FIG. 4. In FIG. 4 there is a motor 449 having an output shaft 451. The output shaft 451 by means of a belt 453 connects with the shaft 138 of the harvester machine chipper head assembly 130. On the shaft 138 there is a cog belt pulley 455 which connects by means of a belt to a cog belt pulley 457 on a shaft 459. The shaft 459 is an inlet shaft to the gearbox 461. The gearbox 461 has an output shaft 463. On the output shaft 463 there is a sprocket 465 and which sprocket by means of suitable chain and sprockets connect with the lower support rolls 443 for powering the lower support rolls 443 and also connect with the shaft 447 for powering the upper feed rolls 445; and, which connect with the lower support rolls 468 for powering the lower support rolls 468 and connect with the shaft 470 for powering the upper feed rolls 472.

In FIG. 4 there is illustrated lower support rolls 474 on the inlet feed table to the harvester machine 441.

Further, in FIG. 3 it is seen that the lower powered support rolls 443 and 468 define a lumber line 476 in the harvester machine 441.

In FIGS. 14, 15 and 16 there is illustrated an anvil 123 for use with a salvage machine chipper head assembly. In FIGS. 17 and 18 there is illustrated a salvage machine chipper head assembly. In FIGS. 19 and 20 there is illustrated the combination of the salvage machine chipper head assembly and the anvil.

The anvil 123 comprises a main bearing surface 480, a leading edge 482 and a chamfered upper edge 484. Also, the anvil 123 has a trailing or rearward surface 486. The reader is reminded that in the salvage machine the chipper head assembly is of a substantially uniform diameter and therefore the anvil can be of a solid nature of a uniform lateral cross-sectional configuration, see FIGS. 14, 15, 16 and 19.

In FIGS. 55, 56, 57, 58, 59, 65 and 66, there is illustrated a modification of an anvil 500, having a fixed member 502 and a movable member 504.

In FIGS. 56, 58, 59, 65 and 66 there is illustrated the fixed member 502. The fixed member 502 has a main bearing surface 505, a leading edge 506 having a chamfer 508, a first front cutting edge 510, a second front cutting edge 512 and a third front cutting edge 514, extended bearing surfaces 516, 518, 520 and 522. Also, the fixed member 502 slopes downwardly and rearwardly at 524, as in anvil 381. However, the anvil in back of the front cutting edges is substantially cut away or removed to form slots. In back of the front cutting edge 510 there is the first slot 526; in back of the second front cutting edge 512 there is a second slot 528; and, in back of the third front cutting edge 514 there is the slot 530. In each of these slots there is a surface 532 and which surface is substantially at a right angle to the main bearing surface 505. Again, the fixed part of the anvil 500 is the member 502.

The moveable part 504 of the anvil 500 comprises a base member 536 having a first upwardly directed leg 538, a second upwardly directed leg 540, and a third upwardly directed leg 542. The first upwardly directed leg 538 moves in the first slot 526, the second upwardly directed leg 540 moves in the second slot 528 and the third upwardly directed leg 542 moves in the third slot 530. The movable member 504 has, see FIG. 56, a left ear 544 and a right ear 546.

The harvester machine chipper head assembly 130 is in a housing 550.

A clevis and rod 548 connect with the left ear 544 and a left bracket 552 of the housing 550. A clevis and rod 554 connect with the right ear 546 of the movable part of the anvil and a right bracket 556 of the housing 550.

There is a fluid actuated cylinder 558 having a plunger or rod 560. The plunger or rod 560 connects with a first lever arm 562 of a bell crank. The bell crank has the lever arms 562 and 564 which are fixedly positioned on a shaft 566. The lever arm 564 connects with a connecting link 568 which connects with the housing 550.

If a slab or a flitch or a wane edge cant is less thick than the preceding piece of wood then the harvester machine chipper head assembly 130 is moved downwardly. This is accomplished by sending the plunger 560 to the right and moving the lever arms 562 and 564 in a clockwise direction and to move the connecting link 568 downwardly. The housing 550 and the harvester machine chipper head assembly 130 move downwardly. Likewise, the movable part 504 of the anvil moves downwardly while the fixed part 502 of the anvil does not move. Conversely, if the slab or flitch or wane edge cant is thicker than the preceding piece of wood then, the harvester machine chipper head assembly 130 is raised or elevated. This is accomplished by retracting the plunger 560 so as to rotate the lever arms 562 and 564 in a counterclockwise direction and to raise or elevate the connecting link 568. The housing 550 and the harvester machine chipper head assembly 130 are elevated and, likewise, the movable part 504 of the anvil is elevated. Again, the fixed part 502 of the anvil does not move. The change in the position of the movable part of the anvil 504 with respect to the fixed part of the anvil 502 and the positioning of the harvester machine chipper head assembly 130 with respect to the movable part of the anvil 504 and the fixed part of the anvil 502 is illustrated in FIGS. 65 and 66.

In FIGS. 61 through 64 there is schematically illustrated the combination of a chipper head assembly and an anvil wherein the chipper heads of the chipper head assembly are capable of being moved longitudinally on the shaft of the chipper head assembly.

The chipper head assembly 300, see FIG. 68, is used in conjunction with an anvil 600 having a main bearing surface 602, a front or leading edge 604 with a chamfered portion 606 on the upper part of the front leading edge, two spaced apart extended bearing surfaces 608 and 610, a front cutting edge 612 between the extended bearing surfaces 608 and 610, and a rearwardly and downwardly sloping support surface 614. The reader can readily appreciate the reason for only one front cutting surface as the splitter chipper head 308 is fixedly positioned in the chipper head assembly while the chipper head 322 and 312 are free to move on the shaft 302 and on the sleeves 304 and 306.

The reader will readily appreciate that with the chipper heads 312 and 322 longitudinally movable on the shaft 302, it is not practical to have an extended bearing surface between the bearing surface 608 and 610 and therefore it is desirable to have only one front cutting edge 612.

Having presented my invention what I claim is:

1. A chipper head assembly for rotary milling and climb cutting a piece of wood, said assembly comprising:

a. a first chipping knife;
b. a second chipping knife;
c. said first chipping knife having a radial cutting edge and an annular cutting edge for cutting on the face of the piece of wood;
d. said second chipping knife having an annular cutting edge for cutting on the face of the wood;
e. the annular cutting edge of the first chipping knife being on a larger radius than the annular cutting edge of the second chipping knife;
f. a plurality of first chipping knives in a side-by-side relationship to form a first sub-assembly;
g. a plurality of first chipping knives in a side-by-side relationship to form a second sub-assembly; and,
h. a first means to position said first sub-assembly and said second sub-assembly in a spaced apart relationship on the same arbor.

2. A chipper head assembly according to claim 1 and comprising:

a. a plurality of second chipping knives in a side-by-side relationship to form a third sub-assembly;
b. a plurality of first chipping knives in a side-by-side relationship to form a fourth sub-assembly; and,
c. said third sub-assembly and said fourth sub-assembly on the same arbor and with the third sub-assembly being between the second sub-assembly and the fourth sub-assembly.

3. A chipper head assembly for rotary milling and climb cutting a piece of wood, said assembly comprising:

a. a first chipping knife;
b. a second chipping knife;
c. said first chipping knife having a radial cutting edge and an annular cutting edge for cutting on the face of the piece of wood;
d. said second chipping knife having an annular cutting edge for cutting on the face of the wood;
e. the annular cutting edge of the first chipping knife being on a larger radius than the annular cutting edge of the second chipping knife;
f. a plurality of first chipping knives in a side-by-side relationship to form a first sub-assembly;
g. a plurality of first chipping knives in a side-by-side relationship to form a second sub-assembly;
h. a first means to position said first sub-assembly and said second sub-assembly in a spaced apart relationship on the same arbor;
i. a second means to movably position said first sub-assembly on said arbor so as to vary the distance between the first sub-assembly and the second sub-assembly.

4. A chipper head assembly according to claim 3 and comprising:

a. said second means comprising a first fluid actuated ram connecting with and for moving said first sub-assembly on said arbor.

5. A chipper head assembly according to claim 4 and comprising:

a. said second means comprising a first thrust bearing connecting with said first sub-assembly; and,
b. a first yoke connecting together said first thrust bearing and said first fluid actuated ram.

6. A chipper head assembly according to claim 4 and comprising:

a. said first means comprising a second fluid actuated ram connecting with and for moving said second sub-assembly on said arbor.

7. A chipper head assembly according to claim 4 and comprising:

a. said first means comprising a second thrust bearing connecting with said second sub-assembly; and,
b. a second yoke connecting together said second thrust bearing and said second fluid actuated ram.

8. A chipper head assembly for rotary milling a piece of wood, said assembly comprising:

a. a first chipping knife;
b. said first chipping knife having a radial cutting edge and an annular cutting edge for cutting on the face of the piece of wood;
c. a plurality of first chipping knives in a side-by-side relationship to form a first sub-assembly;
d. a plurality of first chipping knives in a side-by-side relationship to form a second sub-assembly;
e. a shaft;
f. a first means to position said first sub-assembly on said shaft; and,
g. a second means to movably position said second sub-assembly on said shaft so as to vary the distance between the first sub-assembly and the second sub-assembly.

9. A chipper head assembly according to claim 8 and comprising:

a. said second means comprising a first fluid actuated ram connectins with and for moving said second sub-assembly on said shaft.

10. A chipper head assembly according to claim 9 and comprising:

a. said second means comprising a first thrust bearing connecting with said second sub-assembly; and,
b. a first yoke connecting together said first thrust bearing and said first fluid actuated ram.

11. A chipper head assembly according to claim 8 and comprising:

a. said first means comprising a second fluid actuated ram connecting with and for moving said first sub-assembly on said arbor.

12. A chipper head assembly according to claim 11 and comprising:

a. said first means comprising a second thrust bearing connecting with said first sub-assembly; and, b. a second yoke connecting together said second thrust bearing and said second fluid actuated ram.

13. A chipper head assembly according to claim 8 and comprising:

a. a second chipping knife;

b. said second chipping knife having an annular cutting edge for cutting on the face of the wood;

c. the annular cutting edge of the first chipping knife being on a larger radius than the annular cutting edge of the second chipping knife;

d. a plurality of second chipping knives in a side-by-side relationship to form a third sub-assembly;

e. said third sub-assembly being fixedly positioned on said shaft; and, f. said first sub-assembly being positioned between said second sub-assembly and said third sub-assembly.

14. A chipper head assembly according to claim 13 and comprising:

a. said second means comprising a first fluid actuated ram connecting with and for moving said second sub-assembly on said shaft.

15. A chipper head assembly according to claim 14 and comprising:

a. said second means comprising a first thrust bearing connecting with said second sub-assembly; and, b. a first yoke connecting together said first thrust bearing and said first fluid actuated ram.

16. A chipper head assembly according to claim 8 and comprising:

a. said first cutting knife having a face, a back and sides between the face and the back, and a heel;

b. said heel sloping inwardly from the upper part of the face to the upper part of the back;

c. the width dimension of the face being larger than the width dimension of the back so that the width of the cutting knife decreases upon going from the face to the back;

d. the junction of the side and the edge of the face projecting forwardly of the main part of the face so as to have a recessed face;

e. the junction of the side and the edge of the face defining said radial cutting edge; and, f. the junction of the face and the heel defining said annular cutting edge of said first chipping knife.

17. A chipper head assembly for rotary milling and climb cutting a piece of wood, said assembly comprising:

a. a first chipping knife;

b. a second chipping knife;

c. said first chipping knife having a radial cutting edge and an annular cutting edge for cutting on the face of the piece of wood;

d. said second chipping knife having an annular cutting edge for cutting on the face of the wood;

e. the annular cutting edge of the first chipping knife being on a larger radius than the annular cutting edge of the second chipping knife;

f. a plurality of first chipping knives in a side-by-side relationship to form a first sub-assembly;

g. a plurality of first chipping knives in a side-by-side relationship to form a second sub-assembly;

h. a first means to position said first sub-assembly and said second sub-assembly in a spaced apart relationship on the same arbor;

i. a plurality of second chipping knives in a side-by-side relationship to form a third sub-assembly;

j. said third sub-assembly being fixedly positioned on said arbor; and, k. said third sub-assembly being positioned between said first sub-assembly and said second sub-assembly.

18. A chipper head assembly for rotary milling and climb cutting a piece of wood, said assembly comprising:

a. a first chipping knife;

b. a second chipping knife;

c. said first chipping knife having a radial cutting edge and an annular cutting edge for cutting on the face of the piece of wood;

d. said second chipping knife having an annular cutting edge for cutting on the face of the wood;

e. the annular cutting edge of the first chipping knife being on a larger radius than the annular cutting edge of the second chipping knife;

f. a plurality of first chipping knives in a side-by-side relationship to form a first sub-assembly;

g. a plurality of first chipping knives in a side-by-side relationship to form a second sub-assembly;

h. a first means to position said first sub-assembly and said second sub-assembly in a spaced apart relationship on the same arbor;

i. said first cutting knife having a face, a back and sides between the face and the back, and a heel;

j. said heel sloping inwardly from the upper part of the face to the upper part of the back;

k. the width dimension of the face being larger than the width dimension of the back so that the width of the cutting knife decreases upon going from the face to the back;

l. the junction of the side and the edge of the face projecting forwardly of the main part of the face so as to have a recessed face;

m. the junction of the side and the edge of the face defining said radial cutting edge; and, n. the junction of the face and the heel defining said annular cutting edge of said first chipping knife.

19. A chipper head assembly for rotary milling a piece of wood, said assembly comprising:

a. a first chipping knife;

b. said first chipping knife having a radial cutting edge and an annular cutting edge for cutting on the face of the piece of wood;

c. a plurality of first chipping knives in a side-by-side relationship to form a first sub-assembly;

d. a plurality of first chipping knives in a side-by-side relationship to form a second sub-assembly;

e. a shaft;

f. a first means to position said first sub-assembly on said shaft;

g. a second means to movably position said second sub-assembly on said shaft so as to vary the distance between the first sub-assembly and the second sub-assembly;

h. said first cutting knife having a face, a back and sides between the face and the back, and a heel;

i. said heel sloping inwardly from the upper part of the face to the upper part of the back;

j. the width dimension of the face being larger than the width dimension of the back so that the width of the cutting knife decreases upon going from the face to the back;

k. the junction of the side and the edge of the face projecting forwardly of the main part of the face so as to have a recessed face;

l. the junction of the side and the edge of the face defining said radial cutting edge; and, m. the junction of the face and the heel defining said annular cutting edge of said first chipping knife.

* * * * *